US006855068B2

(12) United States Patent
Antonious

(10) Patent No.: US 6,855,068 B2
(45) Date of Patent: Feb. 15, 2005

(54) METALWOOD TYPE GOLF CLUBHEAD HAVING EXPANDED SECTIONS EXTENDING THE BALL-STRIKING CLUBFACE

(76) Inventor: Anthony J. Antonious, 7738 Calle Facil, Sarasota, FL (US) 34238

( * ) Notice: Subject to any disclaimer, the term of this patent is extended or adjusted under 35 U.S.C. 154(b) by 0 days.

(21) Appl. No.: 10/165,947

(22) Filed: Jun. 11, 2002

(65) Prior Publication Data

US 2003/0228931 A1 Dec. 11, 2003

Related U.S. Application Data

(63) Continuation-in-part of application No. 09/641,705, filed on Aug. 21, 2000, now Pat. No. 6,530,847.

(51) Int. Cl.[7] ..... A63B 53/04

(52) U.S. Cl. ..... 473/327; 473/345; 473/349

(58) Field of Search ..... 473/345, 346, 473/349, 327, 328; D21/733, 734, 735, 752

(56) References Cited

U.S. PATENT DOCUMENTS 3,761,095 A * 9/1973 Thompson
4,319,752 A * 3/1982 Thompson
4,432,549 A * 2/1984 Zebelean ..... 473/346
5,465,970 A * 11/1995 Adams
5,674,136 A * 10/1997 Gorse
D390,616 S * 2/1998 Maltby
5,766,095 A * 6/1998 Antonious
D402,342 S * 12/1998 Antonious
D411,600 S * 6/1999 Antonious
5,954,595 A * 9/1999 Antonious
5,989,134 A * 11/1999 Antonious
6,123,627 A * 9/2000 Antonious
6,530,847 B1 * 3/2003 Antonious

FOREIGN PATENT DOCUMENTS

AU 211781 * 12/1957 ..... 273/167 F

* cited by examiner

*Primary Examiner*—Sebastiano Passaniti
(74) *Attorney, Agent, or Firm*—Welsh & Flaxman LLC

(57) ABSTRACT

A metalwood type golf clubhead including a clubhead body having a toe, heel, upper crown surface, bottom sole surface, side surfaces, rear surface and ball-striking clubface having at least one raised, elongated, aerodynamically shaped reinforcing and stabilizing member extending outwardly from the clubhead body and having at least one frontal ball-striking surface coincident with the ball-striking clubface. The structure provides improved weight distribution for better balance, additional strength and stability to clubhead and provides more effective aerodynamic surfaces to increase clubhead speed.

9 Claims, 19 Drawing Sheets

FIG. 25
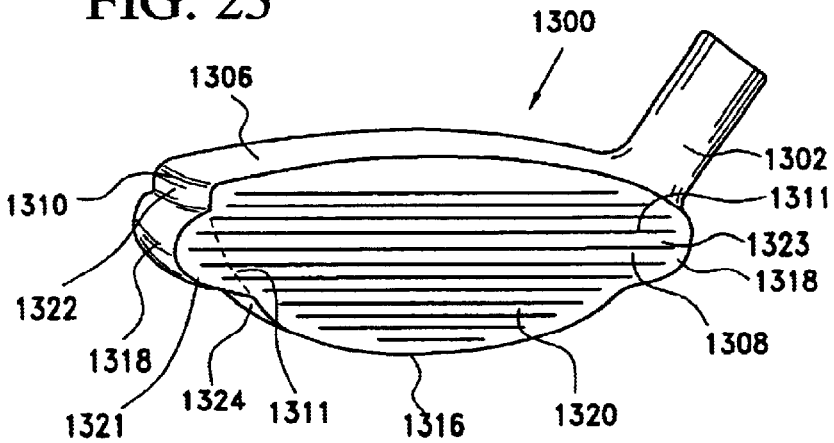
FIG. 28
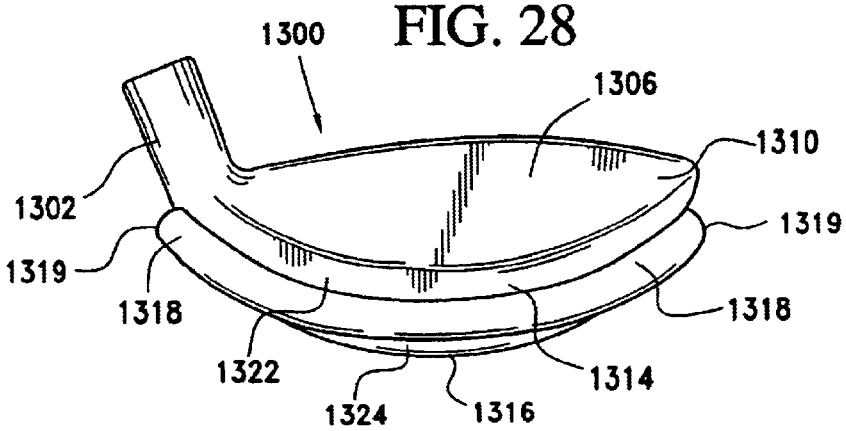
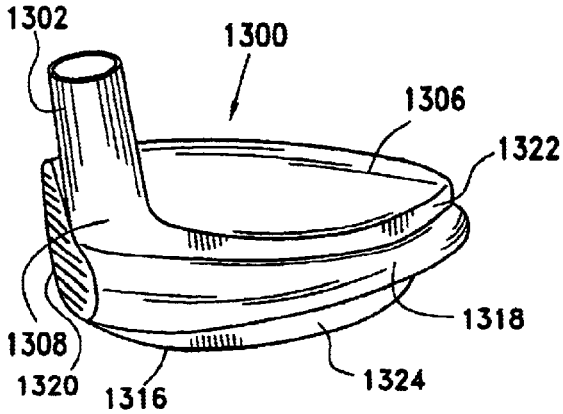
FIG. 26
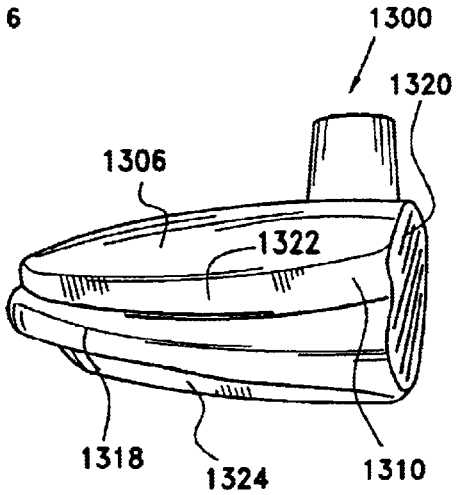
FIG. 27

FIG. 36
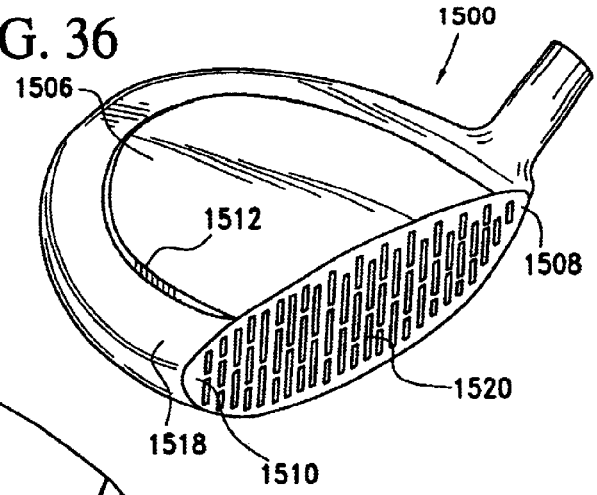
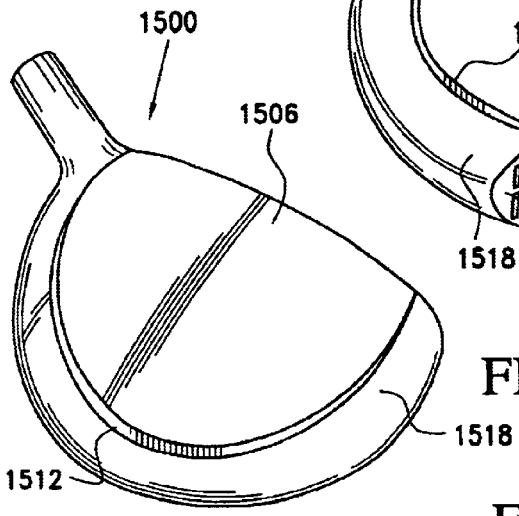
FIG. 37
FIG. 38
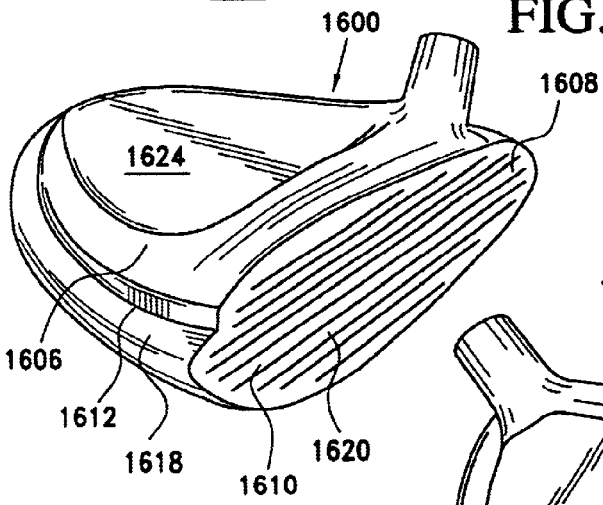
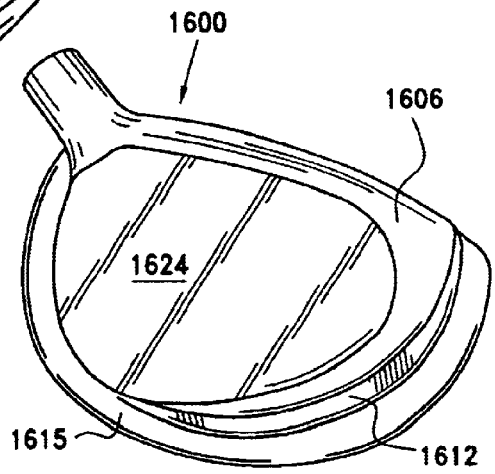
FIG. 39

FIG. 46
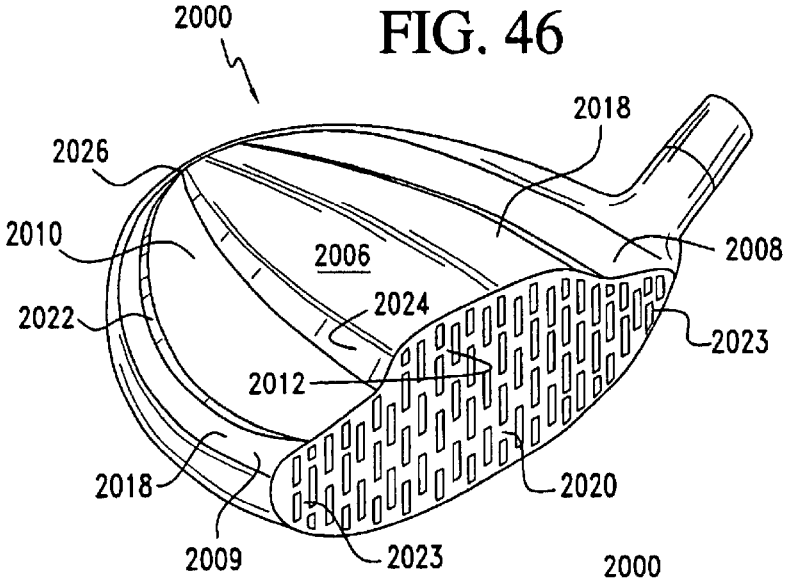
FIG. 47
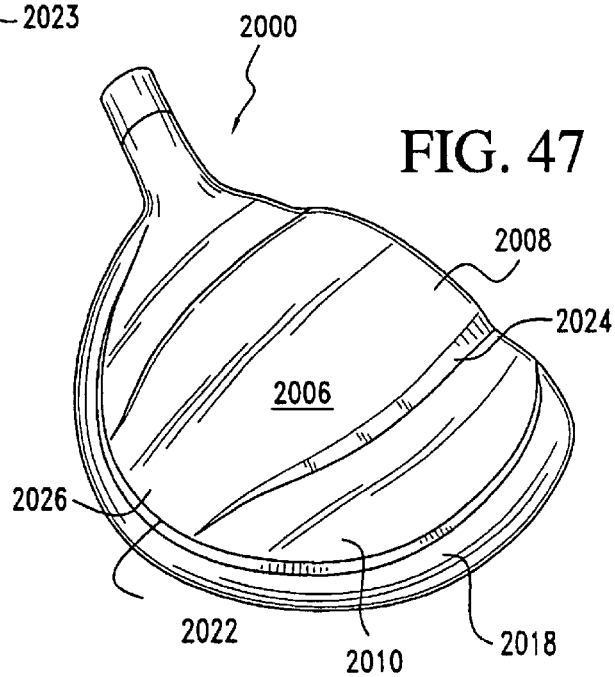
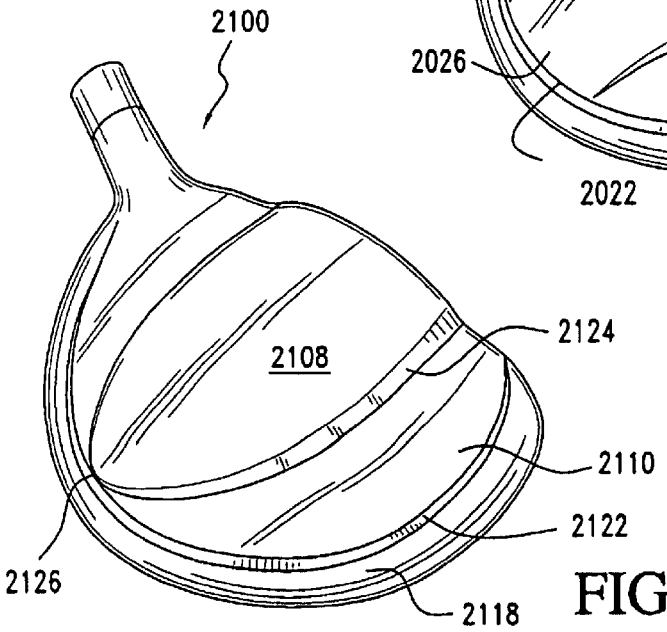
FIG. 48

METALWOOD TYPE GOLF CLUBHEAD HAVING EXPANDED SECTIONS EXTENDING THE BALL-STRIKING CLUBFACE

RELATED APPLICATIONS

The present application is a continuation in part of application Ser. No. 09/641,705 filed Aug. 21, 2000, now U.S. Pat. No. 6,530,847.

BACKGROUND OF THE INVENTION

The present invention relates to the golf clubheads shown and described in my prior U.S. Pat. Nos. 5,954,595, 5,989,134 and co-pending patent application, with Ser. No. 09/641,705, filed Aug. 21, 2000, which are incorporated herein by reference, and in particular, to an improved metalwood type golf clubhead, having at least a reinforcing and stabilizing, hereinafter R/S member, including additional ball-striking surfaces, coincident with and parallel to the clubface and are located at the toe and heel sections of the clubface, enlarging it substantially. The present invention includes downsized top crowns and/or sole sections, disproportionate in size to the much larger expanded ball-contact area of the non-proportionately-sized clubface. Also, the present invention, specifically relates to an R/S member, including ball-striking surfaces coincident with clubface and centrally located vertically on perpendicular plane above and/or below, the clubface of a traditional shaped clubhead.

Most wood-type traditional shaped clubheads are currently made of metal, either totally of steel, titanium, or combined with other alloys. Other clubheads include a shell made of a steel with a face insert that is made of titanium or similar lighter weight material. This permits clubheads to be much larger, yet meet the accepted weight parameters for the respective drivers and fairway type metalwoods.

Although these traditional shaped clubheads are substantially enlarged overall, with higher face heights and wider, bulkier crowns and sole bottoms, their clubfaces have not increased the effective ball-contact hitting area, in a heel to toe direction, proportionately to the overall enlarged clubheads for possible improved performance, for most golfers. To keep the overall clubhead size larger, and lighter, as currently demanded by most higher handicap golfers, the structural integrity of the side walls and the clubfaces, is often compromised. This causes stress cracks, unstable clubhead control at ball contact, and erratic ball flight control, resulting in loss of distance, accuracy, and inability to produce reassuring and repeating solid ball contacts, even when hit flush.

Many attempts have been made to reinforce metal wood type clubheads as shown and described in the prior art. Raymont (U.S. Pat. No. 3,847,399) reinforces the back of the clubface with a honeycomb structure. My U.S. Pat. No. 5,141,230 reinforces the interior of a metalwood with a first mass located behind the ball-striking face, and my U.S. Pat. No. 5,482,279 provides an interior peripheral mass basically along the inner periphery, of the clubhead shell behind the clubface. My U.S. Pat. No. 5,989,134 reinforces the outer side walls, rear, bottom and crown areas of a wood-type golf clubhead. U.S. Pat. No. 5,931,745 to Adams shows a low profile, wood type golf clubhead wherein the bottom sole surface is larger than the upper crown surface.

Various structural improvements have been used to strengthen and modify the integrity of prior art conventional metalwoods. Nevertheless, for most golfers, the subtle changes to the clubhead and the expected performance of the larger metalwood clubheads, have been disappointing. The performance of most of these traditional shaped metalwoods has not materially improved clubhead feel at ball contact, or significantly increased clubhead stability and control for anticipated improved accuracy and additional significant distance. Consequently, these bulkier, over-sized traditional shaped clubheads have not meaningfully advanced the golfers' performance potential.

SUMMARY OF THE INVENTION

The versatile concept of the present invention includes distinctively different aerodynamically designed reinforcing and stabilizing (R/S) members that perform totally different functions on the clubheads, independently of each other. The R/S members include ball-striking surfaces that are coincident with the clubface and are located separately and/or independently, at different sections of the clubhead, to produce preferred and specifically different functions.

The outermost surfaces of the R/S ball-striking faces, located at the toe and heel sections, parallel to the clubface are generally curved, forming parabolic, rounded or elliptical type shapes.

The ball-striking surfaces of the R/S members are coincident with the clubface, and are located parallel to and/or perpendicular to the clubface . . . to dramatically enlarge the respective hitting areas of drivers or fairway clubfaces.

The R/S differences are classified by their distinctive location and independent functional relationship, to the clubface and clubhead:

a) R/S is located parallel to the clubface.

b) R/S is located perpendicular to the clubface.

c) Two R/S members are located at two different locations on the clubhead . . . one parallel to the clubface and the other perpendicular to the clubface.

The concept of the present invention includes an R/S aerodynamic shaped member, located parallel to or horizontal to the clubface and surrounds the clubhead from the toe, rear and heel sections of the clubface. The R/S members include ball-striking surfaces that are coincident with and parallel to the clubface and create the additional parallel expanded ball-contact surfaces, at the toe and heel sections, of the clubface, to provide a substantially larger non-proportionately sized ball-striking area on the clubface. This is accomplished without proportionately enlarging the top or crown section and/or the bottom or sole sections of the clubheads. The improvement utilizes a smaller down-sized crown and sole area than most of the larger traditional shaped clubheads in the range of 230–300 cc and larger. To accomplish this more effective and improved aerodynamic upper section, considerable "excess mass" and bulk formed on the larger traditional shaped clubheads, is eliminated by creating a substantially smaller down-sized top crown located above the clubface. The considerable weight reduction, using the smaller crowns of the present invention, is more effectively utilized to create the unique R/S members, with ball-striking surfaces to expand the hitting areas, at the toe and heel sections of the clubface, of the present invention. The R/S members provide formidable reinforcing and stabilizing capabilities, specifically to the additional expanded sections to the clubface, and to the rear and side walls of the clubhead. The reinforcing and stabilizing R/S members are formed below the interface of the crown and clubface, and extend from the sidewalls and horizontally beyond the ends of the upper crown or sole portions of the clubhead. This improved structural design increases the ball-contact hitting area to the clubface, by as much as 33%. Expanding the hitting areas and increasing the weight at the extreme toe and heel sections, not only provide a higher Moment of Inertia, as needed, but also creates a much larger and more forgiving "sweet spot" on the clubface. This produces a low-profile, high-performance faster accelerating golf clubhead, supremely adaptable for both the driver-type or fairway-type metalwood clubheads.

The reinforcing and stabilizing (R/S) members are the most dominant feature of the present invention. They directly contribute and enhance the optimum performance possible from each of the other subordinate outstanding features of the clubhead. The R/S members include ball-striking surfaces located coincident with and parallel to the clubface, and provide the formidable bracing support extending rearwardly from the R/S expansions at the toe and heel sections of the clubface, to the side walls, and rear of the clubhead. The R/S members form the surrounding outer perimeter and are aerodynamically sculptured to produce substantially greater high-velocity clubhead acceleration that also provide greater "lift" to the clubhead; when executing the faster full swings with the longer shafted metal-wood clubheads. The additional "lift" of the aerodynamic designed reinforcing and stabilizing members, noticeably permit a golfer, when swinging a clubhead weighing approximately 203 grams, to "feel" like it weighs 193 grams. The aerodynamic reinforcing and stabilizing R/S members' functions are comparable to the wings or ailerons, attached to the fuselage of an airplane. Similarly, the advanced aerodynamically-designed versatility and structurally sound and practical concept of the reinforcing and stabilizing members, dramatically produce unparalleled performance with the most impressive overall improvements than any prior art, for metalwood clubheads.

The reinforcing and stabilizing member may include variable thicker walls along the entire R/S to provide more mass at the extreme peripheral sections of the clubhead. This unique structure produces much greater overall clubhead control, strength, and stability, at ball-impact. This structure minimizes or practically eliminates any torqueing and twisting, especially for off-center hits, when metalwood clubheads, of this invention, are swung at the higher-velocity clubhead swing-speeds.

Of paramount importance, is the built-in structural advantage of the present invention that not only greatly enhances clubhead stability and control, reduces torqueing, twisting and knock-back, but also significantly increases the critical Moment of Inertia. This effectively reduces or minimizes the negative effects of off-center ball-contacts made anywhere on the substantially enlarged "hitting" area of the clubface.

Generally the driver-type metalwood clubheads have larger clubfaces than their counterpart fairway woods. Since the faces of the driver metalwoods are "wider and higher" with lesser lofts, which can be in the range of 5° to 11°, golf balls are usually "teed up", at address. This facilitates making "solid ball" contact, more often, within or adjacent to the more rewarding centrally located "sweet spot" on the larger clubface of drivers, which can have heights in the approximate ranges of 1.625" to 2.000".

However, the "wider and higher" clubfaces that create the "low profile" concept of the present invention, also permits having "higher lofts", in addition to "wider and higher" clubfaces, for all sizes of fairway metalwood clubheads. The higher clubface lofts for these fairway woods are in the range of 13° to 28°. The unusual clubface heights for fairway clubheads of this invention are in the approximate range of 1.500" to 1.750".

Having fairway metalwoods with larger and more formidable-sized clubfaces of the present invention, golfers are not intimidated by the size of the standard golf ball. The available ball contact areas of the smaller more "shallow faces" of the conventional fairway woods can be, and often are, intimidating by the much larger size of the golf ball, when aligning it with the "smaller faced" fairway clubs, at address. Unlike the smaller more "shallow faces" of the conventional fairway metalwoods, the much larger hitting area on the fairway metalwood clubfaces of the present invention, increases a golfer's confidence and enhances his ability to make more solid and effective ball contacts, consistently.

A second concept of the present invention includes a more down-sized uppermost top crown with rearwardly sloping sidewalls from the clubface and is surrounded by a much wider upper surface of an adjacent horizontal type R/S member, which is located parallel to the clubface and forms the outer perimeter surrounding the clubhead.

The lower wider upper surface of the adjacent horizontal located R/S member, dramatically improves the aerodynamic characteristics, but also provides more mass closer to the CG. This transformation greatly enhances clubhead stability and control for increased accuracy and minimum loss of distance, especially for off-center ball-contacts made by high-velocity swings.

Most importantly, having a smaller top crown, which eliminates excess "mass and bulk", such as formed at the crown area of traditional shaped larger clubheads, is surrounded by the wider upper surface of the adjacent more aerodynamically designed R/S member, which also forms the outer perimeter, and produces considerably faster clubhead acceleration. This practical and innovative concept is adaptable for driver or fairway metalwood clubheads, which can benefit all caliber of golfers.

The R/S members, include ball-striking faces located parallel to and coincident with the toe, or heel sections of the clubface, or both, are formed below the interface of the crown and upper clubface and can be formed in variable sizes and shapes extending from and adjacent to the outer side walls of the clubhead. This unique structural design, of the reinforcing and stabilizing members, which may partially form the outermost perimeter mass from the toe section to the rear or are formed completely around the clubhead, dramatically alters the center of gravity, for every clubhead made with this invention. This design has a profound effect on the performance of each clubhead, whether they are drivers or fairway metalwoods. The size of the reinforcing and stabilizing R/S members can be narrow or wide and located centrally or in an upper or lower position on the respective side walls of the clubhead. The reinforcing and stabilizing member, located in an upper position on the side walls, produces a lower ball-flight, preferred by the professional and low handicap golfers, especially for driver-type metalwood clubheads. The reinforcing and stabilizing member, located in a lower position on the side walls, will produce a higher ball-flight, best suited for fairway metalwood clubheads and the higher lofted drivers that enhance optimum performance for high-handicap golfers. A centrally located reinforcing and stabilizing member on the side walls, produces a most preferred lower ball-flight, best suited for the professional, and more proficient lower handicap golfers.

Another embodiment of the concept of the present invention, includes an R/S member with a ball-striking surface, located at the extreme lower portion of the clubface. This unique upper and a lower distinctive hitting area on the clubface, includes a reinforcing and stabilizing (R/S) member that is located on the bottom of the clubhead and extends rearwardly from its own ball-striking face surface, which is coincident with and perpendicular to the clubface. The extraordinary overall construction of the present invention, not only minimizes or eliminates undesirable shocks and vibrations from "thin" shots, but produces the most formidable clubhead stability, when the most severe off-center ball contacts occur, even when made at the extreme toe, heel or lowest portion of the clubface. The outermost extending surfaces of the laterally expanded areas to the fairway wood clubfaces, are generally curved, forming parabolic, rounded, or elliptical type end shapes.

This unique structural and versatile concept permits combining the advantages of both distinctively different R/S members, in shape and size, to be formed at different locations on the clubhead to produce improved functions in a superior high-performing clubhead.

Another embodiment combines an R/S member located parallel to and coincident with the clubface and a downsized R/S member formed as a top crown located perpendicular to and above the clubface, immensely enlarges the clubface, both horizontally and vertically.

The improvements of the present invention offer a more formidable and unmatched structural, overall, clubhead design for metalwoods. With this invention, golfers increase their confidence in their golf swing, permitting them to steadily improve their ability to repeatedly execute solid ball contact with greater accuracy and surprisingly greater distance.

The important effect of the aerodynamic behavioral characteristics, especially for the larger metalwood clubheads, is always a most critical aspect, in its overall design. The quest to create a substantive improvement in a metalwood clubhead, that exceeds the performances of all competitive leading brands, will always present a challenge for anyone involved in the design and development of metalwood clubheads. The improved adaptability and flexibility of the concepts of this invention accomplishes this objective, in a novel, practical and worthy manner by producing different results in a different manner.

The expanded areas to the clubface, extend beyond a vertical plane defined by the boundaries of the top crown surface and bottom sole of the main clubhead body, as shown in the application drawings.

The present invention for metalwoods enlarges the ball contact area on the clubface, non-proportionately to the size of the top or crown sections, or sole or bottom sections, of the clubhead, unlike that which is done for the prior art medium to large size metalwoods, generally in the range of 230–300 cc or larger. In fact, the ends or boundaries of the crown and sole sections, as designed, for such larger conventional clubheads, lie within the vertical plane alignment clearly defined for these larger prior art clubheads. By contrast, the additional horizontally expanded sections of the R/S of the present invention, on some embodiments, located parallel to the clubface, laterally enlarge the ball contact areas, particularly at the outermost ends of the toe and heel sections of the clubface, substantially beyond that of conventional metalwood clubfaces, and are located horizontally beyond or outside the established vertical plane alignment of other prior art metalwoods.

The expanded additions on some specific metalwoods of the present invention, create the larger expanded ball contact areas parallel to the clubface, and are located and extend in a horizontal relationship, beyond the traditional shaped toe and heel sections of the diminishing ball contact areas of the clubfaces of the traditional shaped metalwood type clubheads. The additional formation of the reinforcing and stabilizing R/S weight members, extend and continue rearwardly (face to rear) from the expanded sections, to the clubface, that also produce the outermost perimeter of the clubhead. This R/S concept permits an extraordinary overall improved clubhead structural improvement.

Comparison of Dimensions
To Selected Large Size Metalwood Clubheads

| Description of Dimension | Prior Art Ping 330 cc Model | Prior Art TaylorMade Driver Model | Present Invention |
|---|---|---|---|
| Actual Dimensions: (From Sample Clubheads) | (As shown in FIG. 23) | | (As shown in FIGS. 16, 17, 18 and 20) |
| Across Top/Crown: (At Center/Toe to Heel) | | | |
| a) Width of Crown | 4.625" | 4.500" | 2.500"–3.500" |
| b) Width from outer perimeter of opposing side walls of clubhead | 4.625" | 4.500" | 3.500" |
| c) Width from outer surfaces of opposing reinforcing and stabilizing members forming outermost perimeter beyond side walls located at rear, toe, and head sections of clubhead | Does not have this innovation | Does not have this innovation | 4.500" |
| Face: Length/Front to rear | 3.750" | 3.250" | 3.000" |
| Face: Height/Between sole and crown | 2.000" | 1.750" | 1.625"–2.000" |
| Face: At widest point (Laterally from toe to heel) | 4.000" | 3.500" | 4.500" |
| Clubhead Weight Range (in grams) | 200–205 | 200–203 | 198–202 |
| Clubhead CC | 330 cc | 300 cc | 270–360 cc |
| All Titanium Clubhead | Yes | Yes | Yes |

In another embodiment, reinforcing and stabilizing R/S members, including ball-striking surfaces, are parallel to and coincident with the clubface, and located along the lower portion of the clubhead, whereby their bottom or lower surfaces, are coincident with the bottom or sole surface of the clubhead. In other embodiments, the ball-striking surfaces parallel to and coincident with the clubface are located in between and/or adjacent the crown and sole surfaces of the clubhead.

Other embodiments include a shelf or a set back area at the interface of the crown and ball-striking clubface in combination with the R/S having ball-striking surfaces parallel to and coincident with the toe and heel sections of clubface.

Among the objects of the present invention is the provision of metalwood type golf clubheads that enhance the potential for greater improved performance, for all caliber of golfers.

Another object of the present invention is the provision of metalwood type golf clubheads, particularly for medium to large size metalwood clubheads, in the range of 230–300 cc and larger, provide R/S members with additional expanded ball-striking surfaces to the clubface. The additional R/S ball contact areas, located parallel to and coincident with the toe and heel sections of the clubface, extend horizontally and considerably beyond the ends of clubfaces or side walls of traditional shaped clubheads.

Another object is the provision of metalwood type golf clubheads having reinforcing and stabilizing R/S band-like members extending from the additional expanded sections parallel to the clubface and beyond the side walls, rearwardly, face to rear, that further create improved aerodynamic characteristics and also forms the outermost perimeter to the clubhead.

Another object of the present invention is the provision that considerably expands the clubface at the toe and heel sections to greatly enlarge the ball contact area, by as much as 33% or more without proportionally enlarging the crown and bottom sections of the clubhead.

Another object of the present invention is the provision that immensely increases the "sweet spot" area on metalwood-type clubheads, which substantially enhances ball feel at contact for improved clubhead control and stability, minimizing errant direction and distance loss.

Another object of the present invention is the provision of creating and locating the massive weight mass of the reinforcing and stabilizing R/S member at the extreme outer surfaces of the clubhead. This provides an optimum level for the Moment of Inertia, as needed, when ball contacts occur off the Center of Gravity anywhere on the clubface.

These and other objects of the present invention will be understood from the drawings and the description that follows or may be learned from the practice of the invention.

DESCRIPTION OF DRAWINGS

FIG. 25 is a front elevational view of a thirteenth embodiment of a golf clubhead in accordance with the present invention.

FIG. 26 is a heel side elevational view of the clubhead of FIG. 25.

FIG. 27 is a toe side elevational view of the clubhead of FIG. 25.

FIG. 28 is a rear elevational view of the clubhead of FIG. 25.

FIG. 36 is a front perspective view of a fifteenth embodiment of a golf clubhead in accordance with the present invention.

FIG. 37 is a top rear perspective view of the clubhead of FIG. 36.

FIG. 38 is a front perspective view of a sixteenth embodiment of a golf clubhead in accordance with the present invention.

FIG. 39 is a top rear perspective view of the clubhead of FIG. 38.

FIG. 46 is a front perspective view of a twentieth embodiment of a golf clubhead in accordance with the present invention.

FIG. 47 is a top rear perspective view of the clubhead of FIG. 46.

FIG. 48 is a top rear perspective view of the clubhead of a twenty first embodiment of a golf clubhead in accordance with the present invention.

DESCRIPTION OF THE PREFERRED EMBODIMENTS

Figure 1:
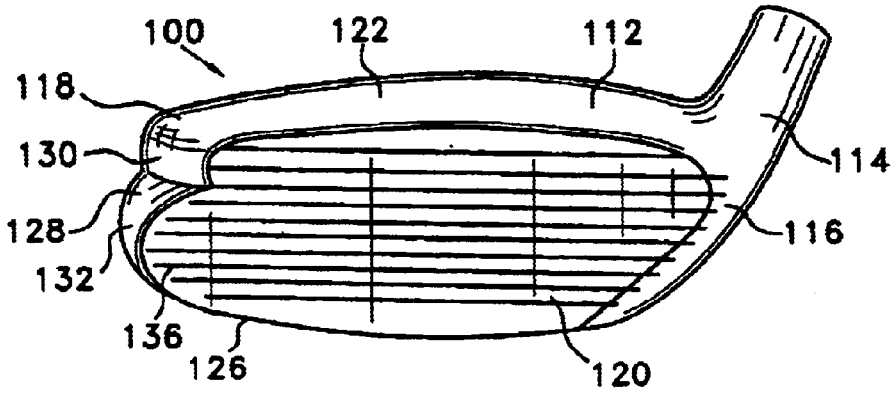
FIG. 1 is a front elevational view of a golf clubhead in accordance with the present invention.
Figure 2:
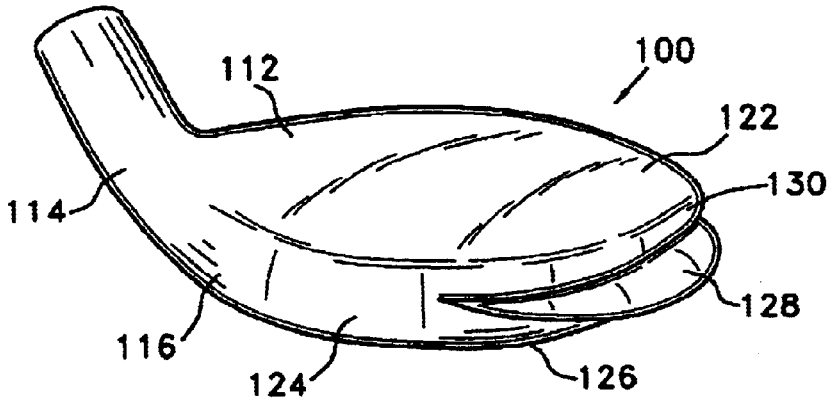
FIG. 2 is a rear elevational view of FIG. 1.
Figure 3:
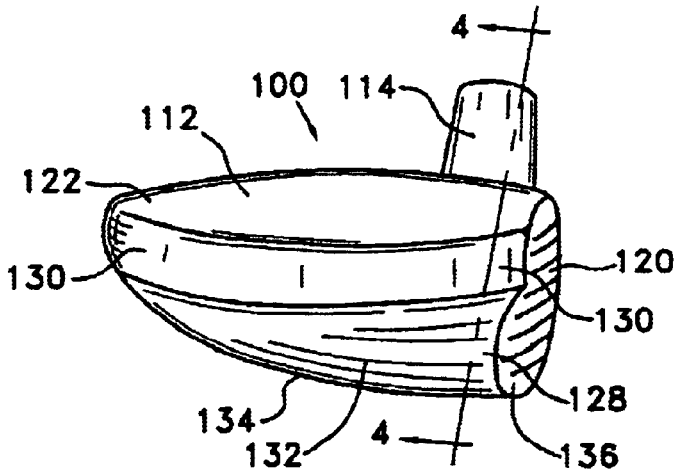
FIG. 3 is an end elevational view of FIG. 1.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–4 show a first embodiment of a golf clubhead 100 in accordance with the present invention including a clubhead body 112, hosel 114, heel 116, toe 118, ball-striking clubface 120, upper surface 122, rear surface 124 and bottom sole 126. A single reinforcing and stabilizing member 128 having an aerodynamic shape, is located coincident with or adjacent to the bottom surface 126 of the clubhead 100 and which wraps partially around the peripheral sides 130 of the clubhead 100. The member 128 includes upwardly curving, convex parabolic surface 132 including a lower surface 134 extending upwardly and coincident with the bottom sole 126 of the clubhead 100. In this embodiment, the member 128 has a front ball-striking surface 136 which is laterally coincident with the ball-striking clubface 120, thereby enlarging the ball contact surface of 120 and providing a greater margin for error when golf balls are struck away from the center of the ball-striking striking clubface 120 toward the toe 118 of the clubhead 100.

Figure 4:
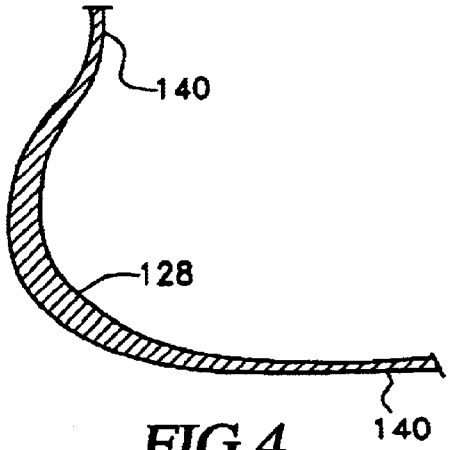
FIG. 4 is a partial sectional view taken along lines 4—4 of FIG. 3.

FIG. 4 is a partial sectional view of the reinforcing and stabilizing member 128 and metal shell 140 of the clubhead 100. The peripheral weight of the clubhead body 112 maybe controlled by varying the thickness of this area. The thickness of the metal shell 140 is preferably in the range of 0.035–0.060 in. or greater, whereas the thickness of the expanded reinforcing and stabilizing member 128 maybe in the range of 0.055–0.100 in. or greater. These dimensions exclude the clubface thickness which can be in the range of 0.090 to 0.130 or less.

Figure 5:
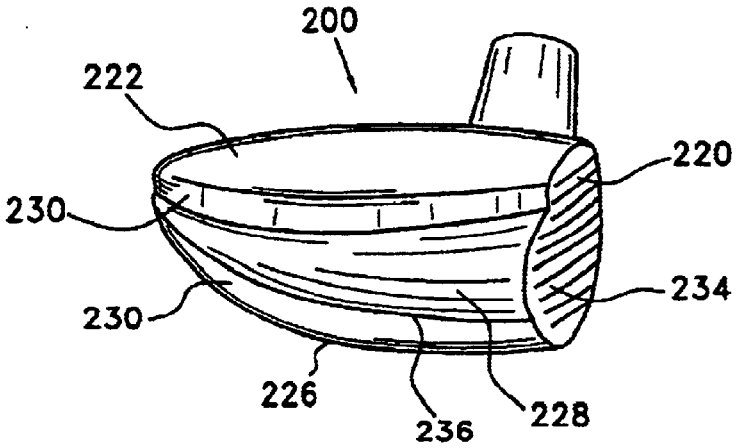
FIG. 5 is an end elevational view of a second embodiment of the present invention.

FIG. 5 illustrates a second embodiment of a golf clubhead 200 of the present invention. In this embodiment a reinforcing and stabilizing member 228 includes a ball-striking surface 234 parallel to clubface 220 with a non-coincident bottom surface 236 is centrally located on the side wall 230 of the clubhead 200 approximately midway between the crown surface 222 and the bottom 226 of the clubhead 200.

Figure 6:
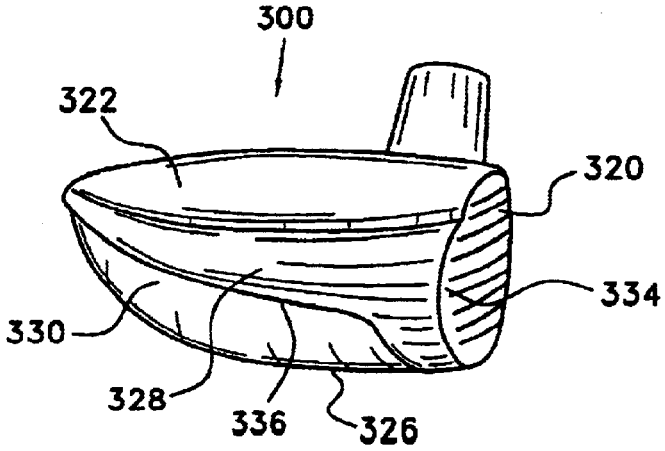
FIG. 6 is an end elevational view of a third embodiment of the present invention.
Figure 7:
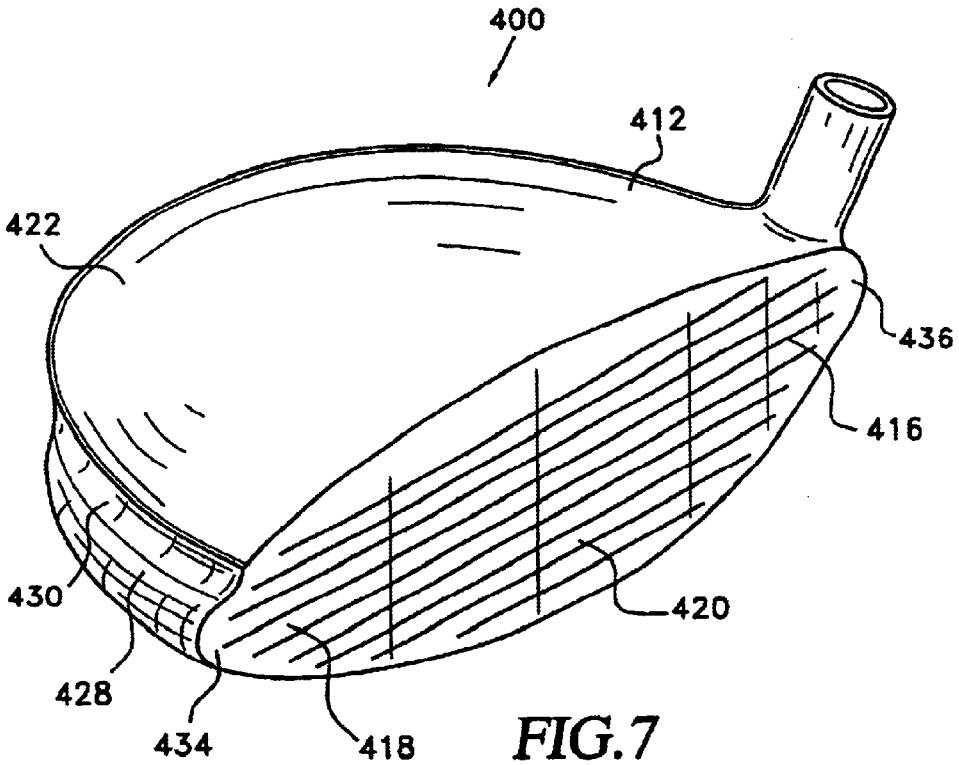
FIG. 7 is a top perspective view of a fourth embodiment of the present invention.
Figure 8:
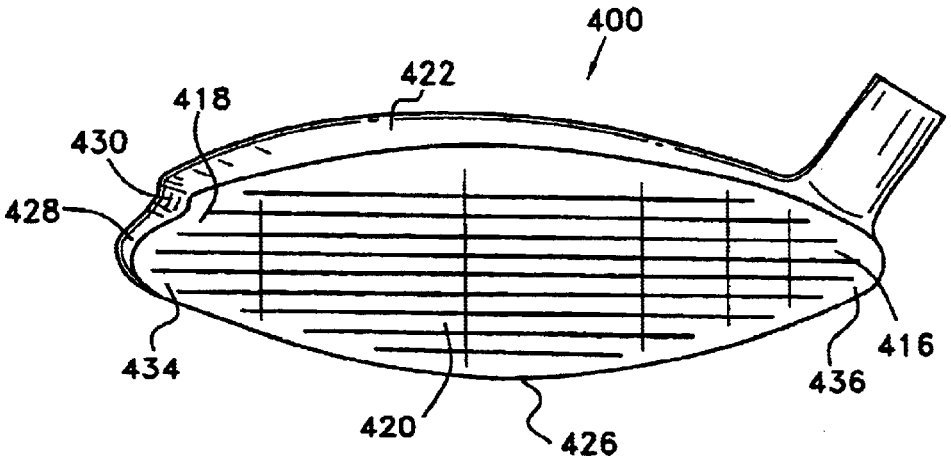
FIG. 8 is a front elevational view of FIG. 7.
Figure 9:
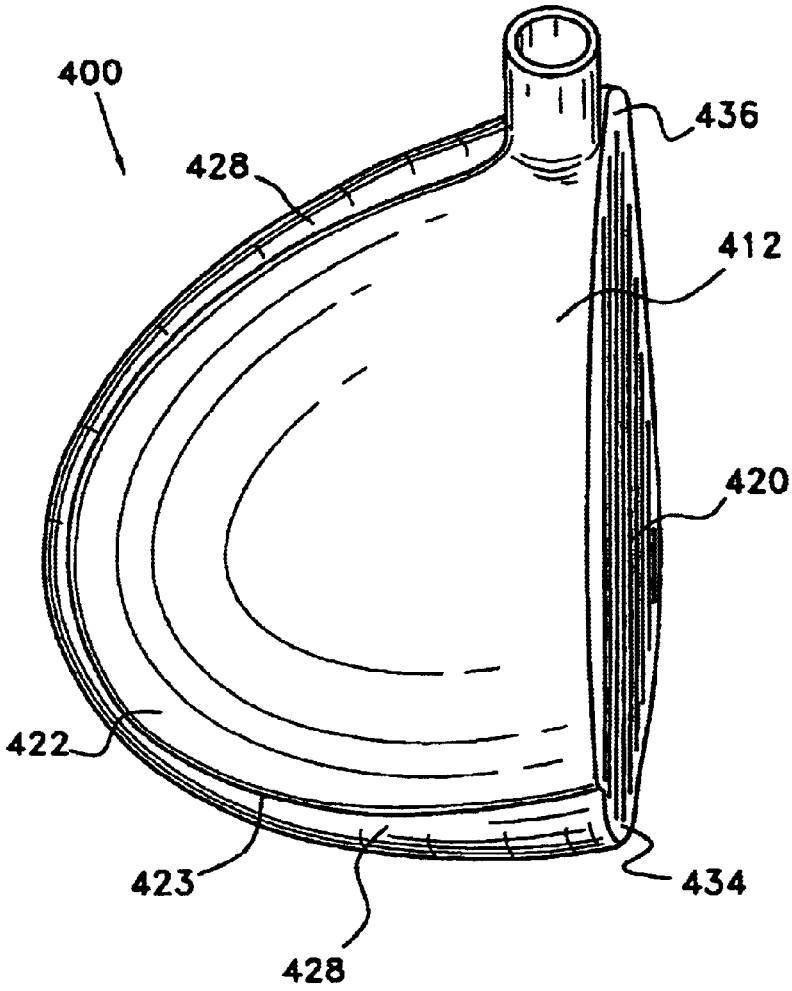
FIG. 9 is a top plan view of FIG. 7.
Figure 10:
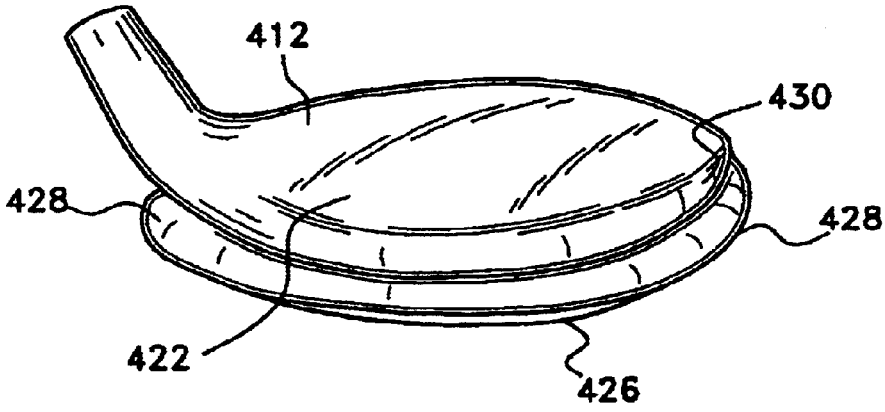
FIG. 10 is a rear elevational view of FIG. 7.
Figure 11:
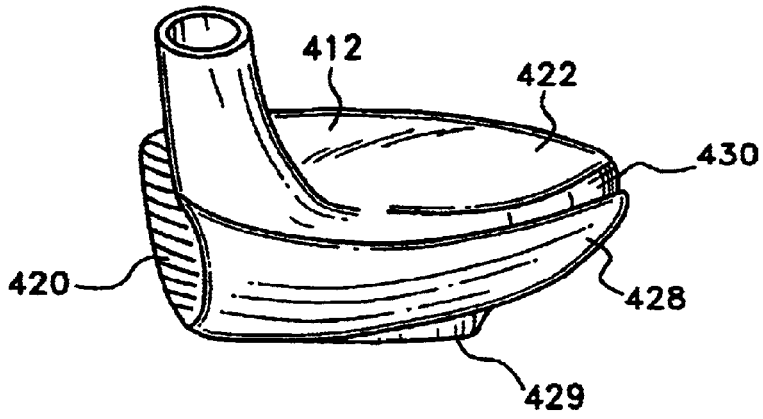
FIG. 11 is an end elevational view of FIG. 7.
Figure 12:
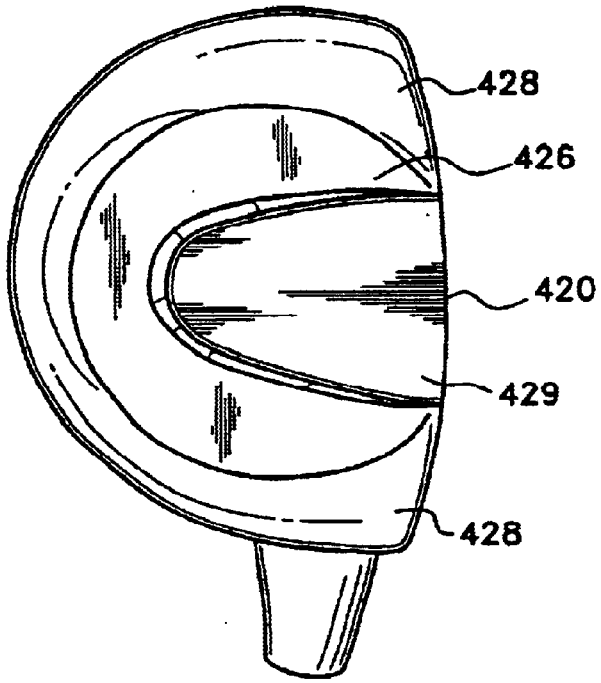
FIG. 12 is a bottom view of FIG. 7.

FIG. 6 illustrates a third embodiment of a golf clubhead 300 of the present invention wherein a reinforcing and stabilizing member 328 includes a ball-striking surface 334 coincident with clubface 320. The reinforcing and stabilizing member 328 has a non-coincident lower surface 336 above the bottom surface of the club head 300. The reinforcing and stabilizing member 328 is located toward the top surface of side wall 330 adjacent the crown surface 322 of the clubhead 300.

FIGS. 7–12 illustrate a fourth embodiment of a clubhead 400 of the present invention. In this embodiment, a reinforcing and stabilizing member 428 is generally elliptical in shape. The member 428 includes front ball-striking surfaces 434 and 436 located parallel to and coincident with the ball-striking clubface 420 of the clubhead 400 and wraps around to surround the clubhead body 412 between the toe 418 and heel 416. As seen in plan in FIG. 9, the member 428 extends outwardly beyond the peripheral edge 423 of the crown 422 and in FIG. 12, the member 428 extends outwardly beyond the bottom 426 of the clubhead 400. The clubhead 400 includes a sole skimmer 429 on the bottom 426.

Figure 13:
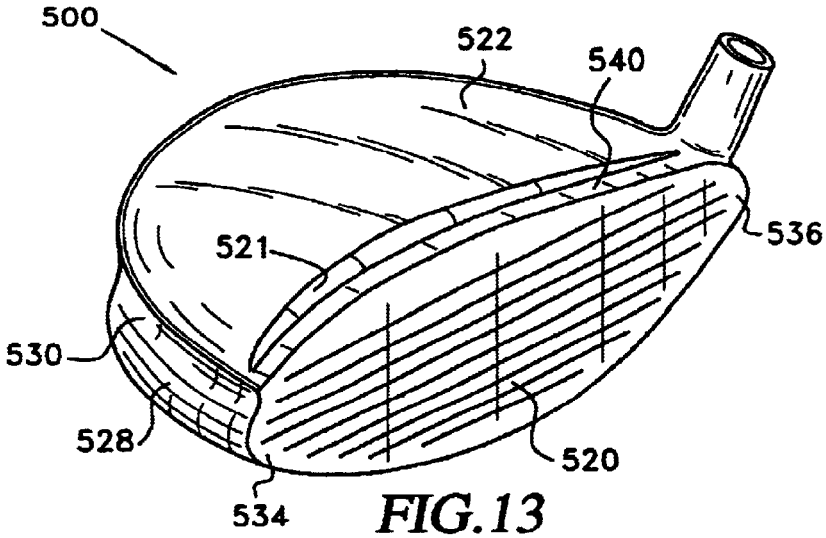
FIG. 13 is a top perspective view of a fifth embodiment of the present invention.
Figure 14:
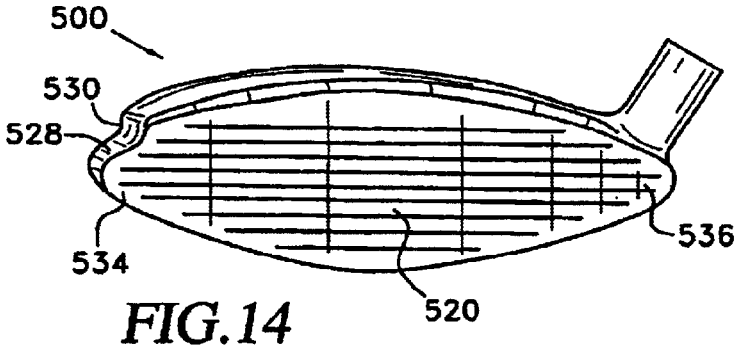
FIG. 14 is a front elevational view of FIG. 13.

FIGS. 13 and 14 illustrate a fifth embodiment of a clubhead 500 of the present invention. A reinforcing and stabilizing member 528 includes front ball-striking surfaces 534 and 536 located parallel to and coincident with the ball-striking clubface 520 of the clubhead 500. A ledge 540 is set back from the ball-striking clubface 520 and sloped front surface 521 of crown 522 favorably alters air flow by more effectively accelerating it across the surface of the crown 522 of the clubhead 500.

Figure 15:
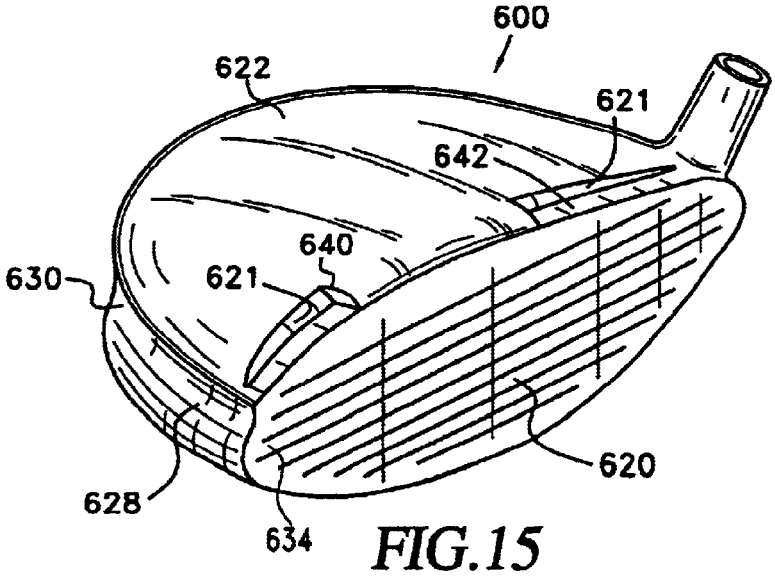
FIG. 15 is a top perspective view of a sixth embodiment of the present invention.

FIG. 15 illustrates a sixth embodiment of a clubhead 600 of the present invention including a reinforcing and stabilizing member 628 with ball-striking surfaces 634 and 636 located parallel to and coincident to ball-striking clubface 620 and a pair of ledges 640 and 642 which are set back from the ball-striking clubface 620 with sloped front surfaces 621 of crown 622.

Figure 16:
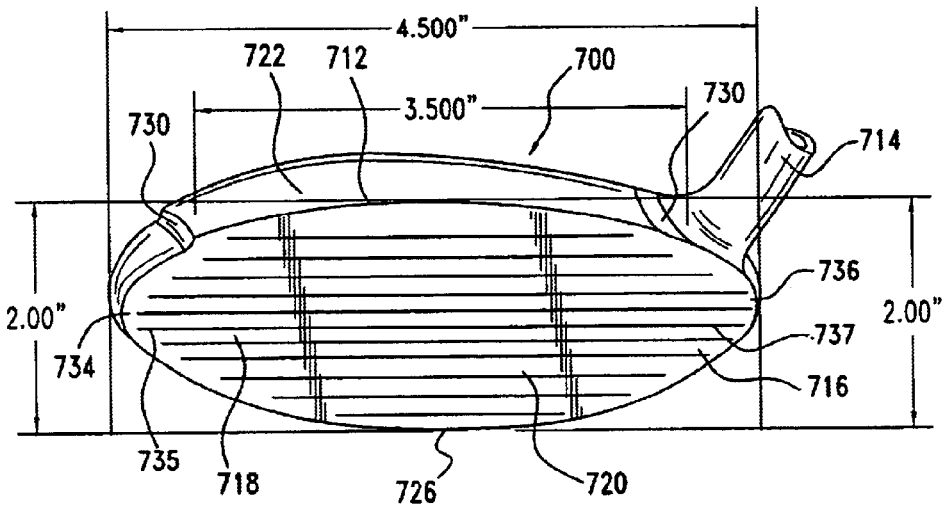
FIG. 16 is a front elevation view of a seventh embodiment of the present invention.

FIG. 16 shows an embodiment of a golf clubhead 700 in accordance with the present invention including a clubhead body 712, hosel 714, heel 716, toe 718, ball-striking face 720, upper surface 722, and bottom sole 726. In this embodiment, reinforcing and stabilizing members 734 and 736, having an aerodynamic shape, include ball-striking surfaces 735 and 737 located coincident with and parallel to the ball-striking clubface 720 of the clubhead 700 and wrap rearwardly surrounding clubhead 700 as with the above-described embodiments. The reinforcing and stabilizing members 734 and 736 extend outwardly beyond the side wall surfaces 730 as defined by the lateral extension of the end boundaries of the upper crown surface 722. In this embodiment, the upper crown surface 722 is approximately 3.500 inches in length in a heel 716 to toe 718 direction. The overall heel to toe length of the ball-striking face 720, including the reinforcing and stabilizing members 734 and 736, is approximately 4.500 inches, with a height of approximately 2.000 inches, thereby extending the lateral dimensions of the clubface approximately one half inch, 0.500 inches, at both the heel 716 and toe 718 of the clubhead 700.

Figure 17:
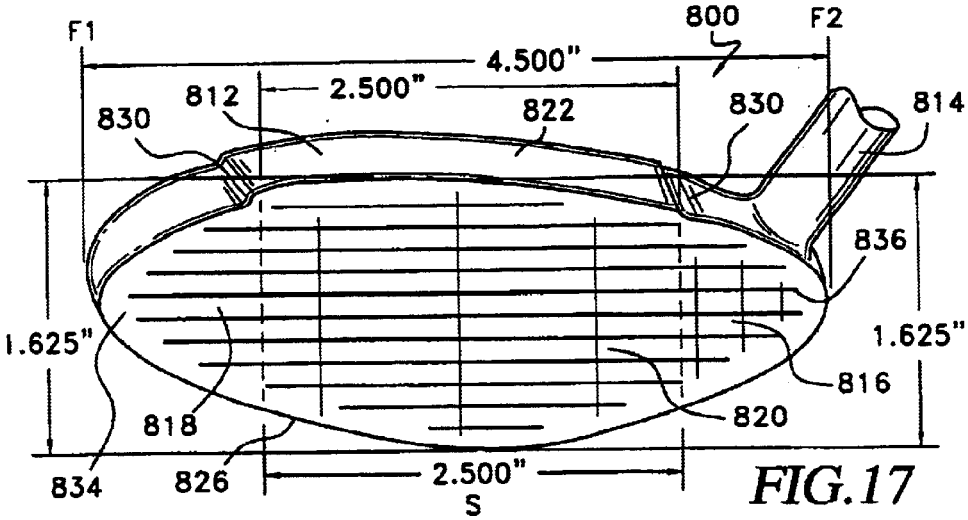
FIG. 17 is a front elevation view of an eighth embodiment of the present invention.

FIG. 17 shows an embodiment of a golf clubhead 800 in accordance with the present invention including a clubhead body 812, hosel 814, heel 816, toe 818, ball-striking clubface 820, upper crown surface 822, and bottom sole 826. In this embodiment, reinforcing and stabilizing members 834 and 836, having an aerodynamic shape, include ball striking surfaces 835 and 837 located coincident with and parallel to the ball-striking clubface 820 of the clubhead 800 and wrap rearwardly surrounding clubhead 800 as with the above-described embodiments. The reinforcing and stabilizing members 834 and 836 extend outwardly beyond the side wall surfaces 830 as defined by the lateral extension of the end boundaries of the upper crown surface 822. In this embodiment, the upper crown surface 822 is shorter than the previous embodiment, approximately 2.500 inches in length in a heel 816 to toe 818 direction. The overall heel to toe length of the ball-striking face 820, including the reinforcing and stabilizing members 834 and 836, is approximately 4.500 inches, with a height of approximately 2.000 inches, thereby extending the lateral dimensions of the clubface approximately one inch, 1.00 inch, at both the heel 816 and toe 818 of the clubhead 800.

Figure 18:
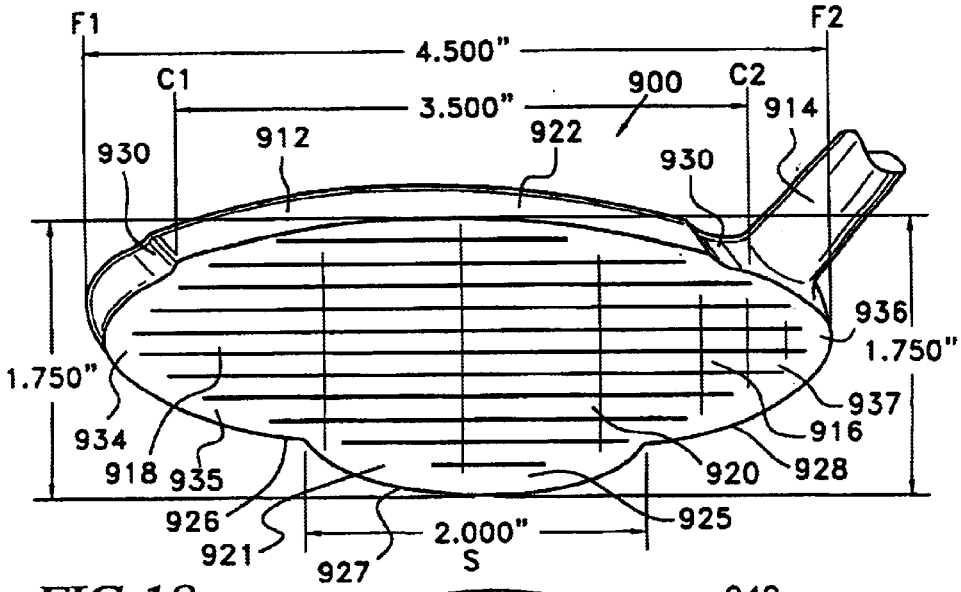
FIG. 18 is a front elevation view of a ninth embodiment of a golf clubhead in accordance with the present invention.
Figure 19:
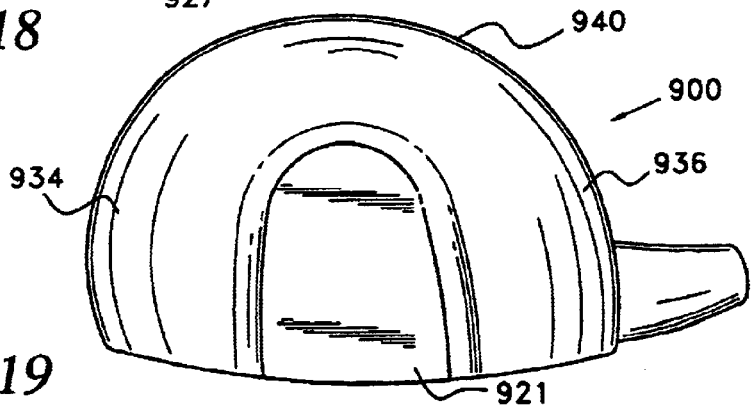
FIG. 19 is a bottom view of the golf clubhead of FIG. 18.

FIGS. 18 and 19 show an embodiment of a golf clubhead 900 in accordance with the present invention including a clubhead body 912, hosel 914, heel 916, toe 918, ball-striking clubface 920, and upper crown surface 922. Reinforcing and stabilizing R/S members 934 and 936, have an aerodynamic shape which wrap rearwardly as with the above-described embodiments, and are located laterally and outwardly from the heel and toe sections 916 and 918 of clubhead 900. Reinforcing and stabilizing members 934 and 936 include front ball-striking surfaces 935 and 937, which are coincident with and parallel to the ball-striking clubface 920 of the clubhead 900 and bottom aerodynamic surfaces 926 and 928. The reinforcing and stabilizing members 934 and 936 extend outwardly beyond the side wall surfaces 930 as defined by the lateral extension of the end boundaries of the upper crown surface 922. In this embodiment, ball-striking clubface 920, has an upper section including the expanded areas of the clubface at 934 and 936, and further includes a reinforcing and stabilizing member 921 having another bottom surface 927, located below bottom surfaces 926 and 928, and having a front ball-striking surface 925 which is coincident with and perpendicular to the ball-striking clubface 920 and extends rearwardly partway to the rear edge 940 of the clubhead 900. This provides a distinctive second lower section expanding the clubface hitting area below the bottom of the ball-striking clubface 920. The reinforcing and stabilizing R/S member 921 extends rearwardly on the bottom surface 926 and supports the clubhead 900 in a slightly raised position above the ground whereby the clubface 920 is in an optimum position to make the most solid ball contact with a golf ball, particularly when the ball is lying in heavy grass or when a "thin" ball-contact occurs especially from "tight lies" on hard fairway surfaces. The upper crown surface 922 is approximately 3.500 inches in length in a heel 916 to toe 918 direction. The overall heel to toe length of the ball-striking clubface 920, including the reinforcing and stabilizing members 934 and 936, is approximately 4.500 inches, thereby extending the lateral dimensions of the clubface approximately one half inch, 0.500 inches, at both the heel 916 and toe 918 of the clubhead 900. The addition of the R/S 921 located below the bottom surfaces 926 and 928 of clubface 920 increases the height range of the clubface 920 up to and beyond 2.500".

Figure 20:
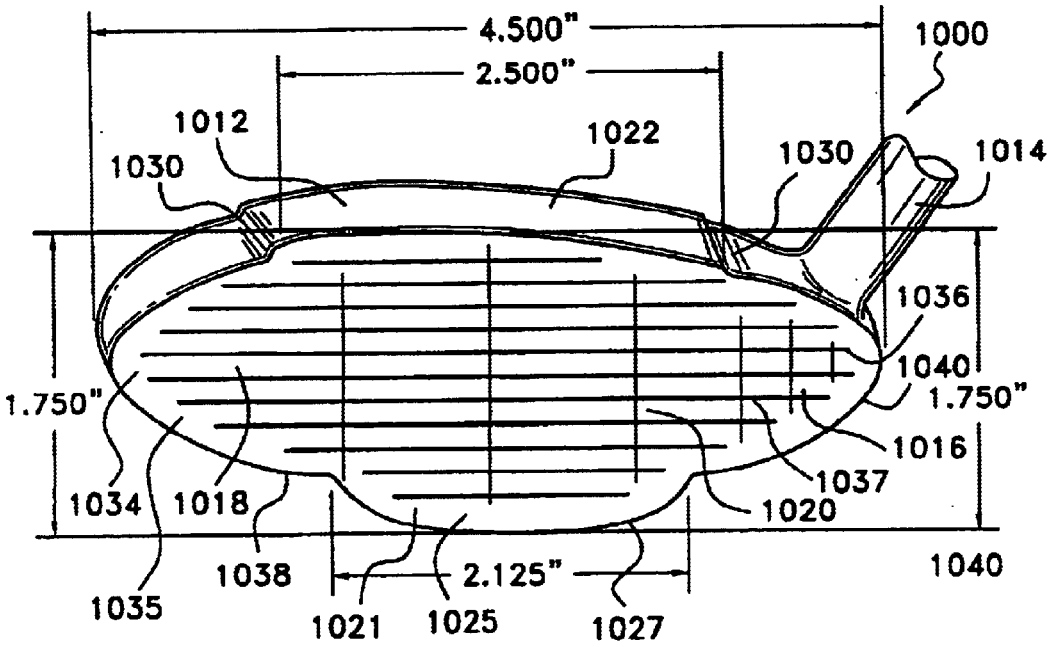
FIG. 20 is a front elevation view of a tenth embodiment of a golf clubhead in accordance with the present invention.

FIG. 20 shows an embodiment of a golf clubhead 1000 in accordance with the present invention including a clubhead body 1012, hosel 1014, heel section 1016, toe section 1018, ball-striking clubface 1020, and an upper crown surface 1022. In this embodiment, reinforcing and stabilizing members 1034 and 1036, have an aerodynamic shape and which wrap rearwardly as with the above-described embodiments, and are located laterally and outwardly from the heel and toe sections 1016 and 1018 of clubhead 1000. Reinforcing and stabilizing members 1034 and 1036 include front ball-striking surfaces 1035 and 1037 which are coincident with and parallel to the ball-striking clubface 1020 of the clubhead 1000 and bottom surfaces 1038 and 1040. The reinforcing and stabilizing members 1034 and 1036 are further defined as extending outwardly beyond the side wall surfaces 1030 at the outer edges or end boundaries limiting the upper crown surface 1022. In this embodiment, ball-striking clubface 1020 includes a lower reinforcing and stabilizing member 1021 having another bottom surface 1027 which includes a front ball-striking surface 1025 coincident with and located perpendicular to and below the ball-striking clubface 1020 thereby providing a substantial additional clubface hitting area at the lowest bottom portion of the ball-striking clubface 1020. The reinforcing and stabilizing member 1021 extends rearwardly between bottom surfaces 1038 and 1040 and supports the clubhead 1000 in a slightly raised position above the ground whereby the clubface 1020 is in an optimum position to strike a golf ball, particularly when the ball is lying in heavy grass or tight lies. The bottom 1027 of the reinforcing and stabilizing member 1021 is non-coincident with and spaced from the bottom surfaces 1038 and 1040 of reinforcing and stabilizing members 1034 and 1036 respectively. The upper crown surface 1022 is smaller at approximately 2.500 inches in length in a heel section 1016 to toe section 1018 direction thereby extending the lateral dimensions of the clubface approximately one inch, 1.00 inch, at both the heel section 1016 and toe section 1018 of the clubhead 1000. The additional ball-striking surface of R/S 1021 creates a higher perpendicular elevation up to 2.500 inches or greater on the clubface 1020.

Figure 21:
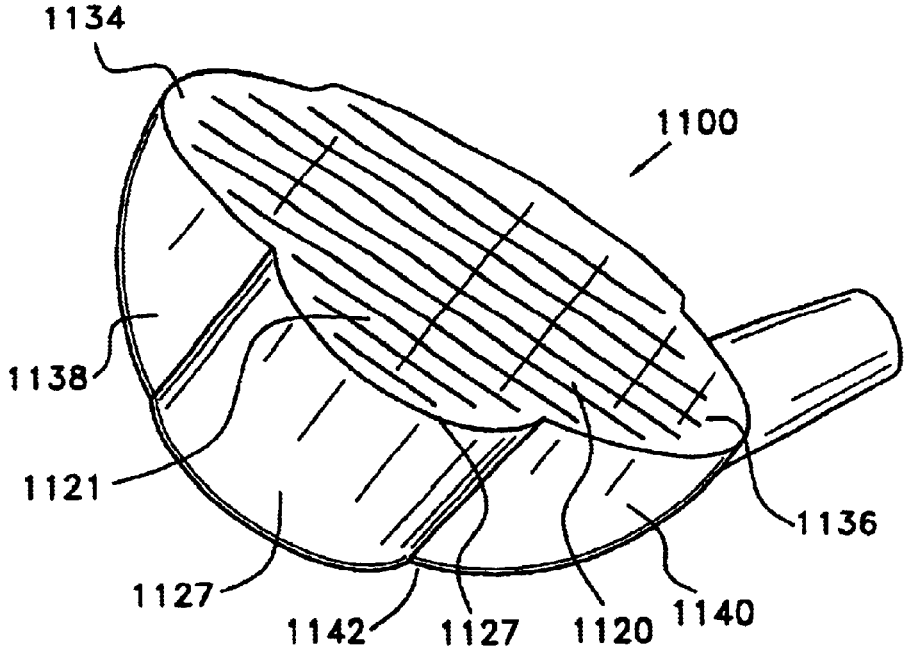
FIG. 21 is a bottom view of a eleventh embodiment of a golf clubhead in accordance with the present invention.

FIG. 21 shows another embodiment of a golf clubhead 1100 in accordance with the present invention having reinforcing and stabilizing members 1134 and 1136 including ball-striking surfaces 1116 and 1118 located parallel to and coincident with clubface 1120 with bottom surfaces 1138 and 1140 respectively, and a reinforcing and stabilizing member 1121 including a ball-striking surface 1122 and a bottom surface 1127 which are coincident with and located perpendicular to the clubface 1120 and which extends rearwardly approximately to the rear surface 1142 of the clubhead 1100.

Figure 22:
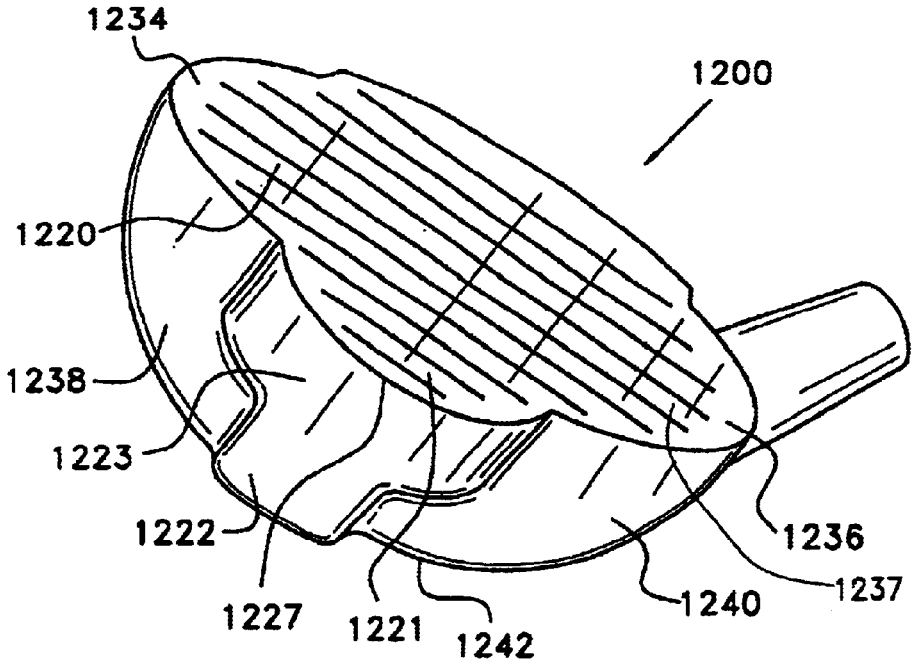
FIG. 22 is a bottom view of a twelfth embodiment of a golf clubhead in accordance with the present invention.
Figure 29:
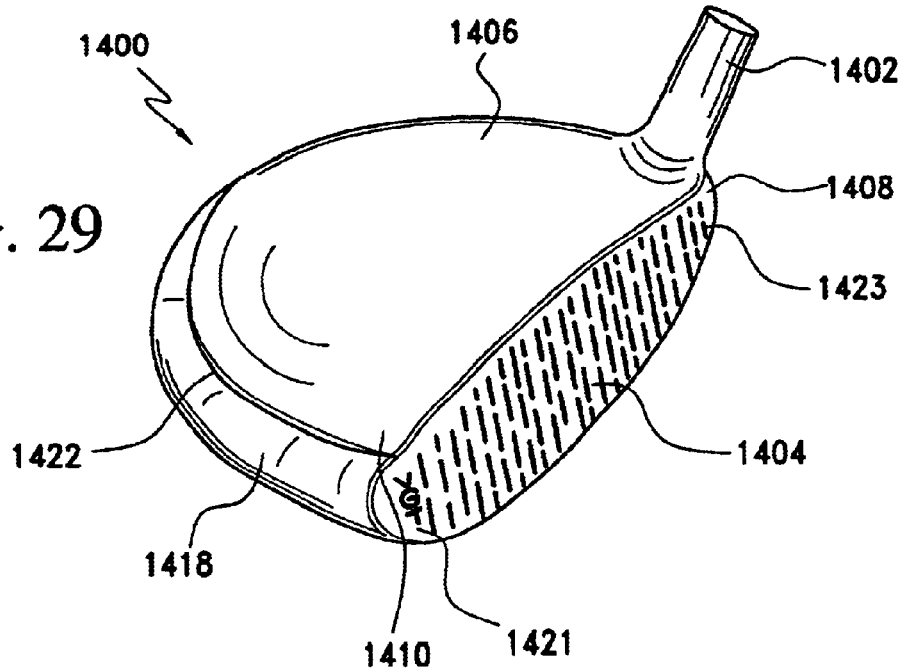
FIG. 29 is a top front perspective view of the clubhead of a fourteenth embodiment of a golf clubhead in accordance with the present invention.
Figure 30:
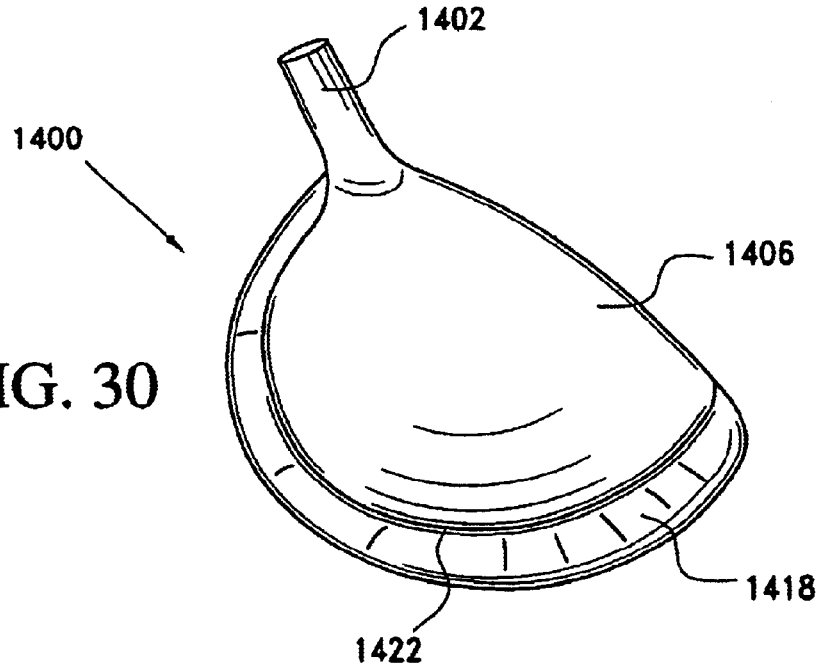
FIG. 30 is a top rear perspective view of the clubhead of FIG. 29.
Figure 31:
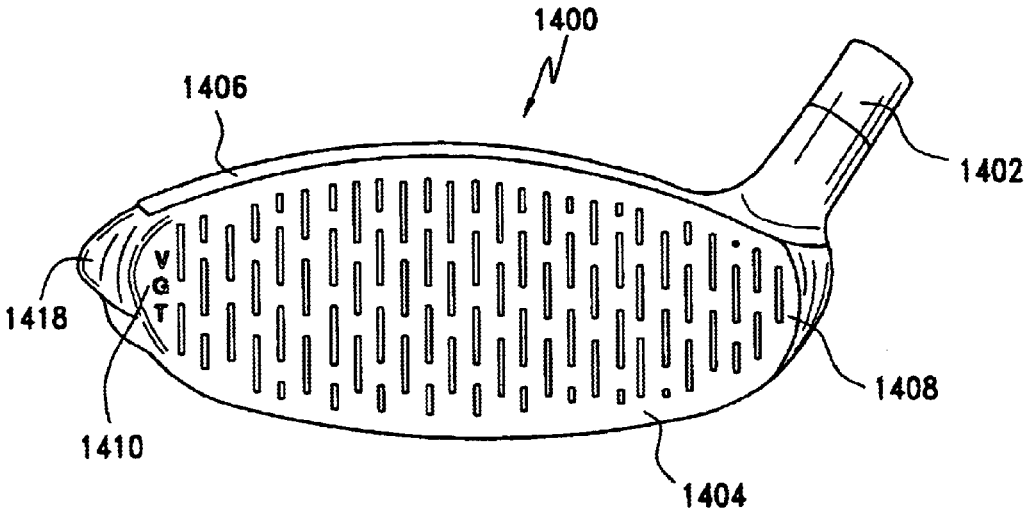
FIG. 31 is a front elevational view of the golf clubhead of FIG. 29.
Figure 32:
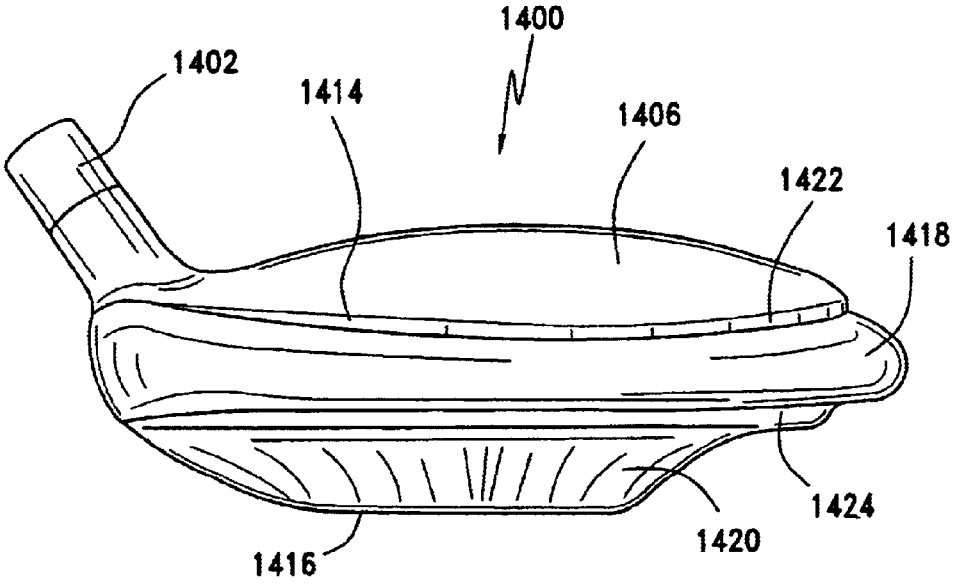
FIG. 32 is a rear elevational view of the golf clubhead of FIG. 29.

FIG. 22 shows another embodiment of a golf clubhead 1200 in accordance with the present invention having reinforcing and stabilizing members 1234 and 1236 including ball-striking surfaces 1235 and 1237 located parallel to and coincident with clubface 1220 with bottom surfaces 1238 and 1240 respectively, and a reinforcing and stabilizing member 1221 including a ball-striking surface and a bottom surface 1227 which is coincident with and located perpendicular to the clubface 1220 and extends approximately to the rear surface 1242 of the clubhead 1200, the rearward portion 1222 of member 1221 being narrower than the front portion 1223 at the clubface 1220.

Figure 23:
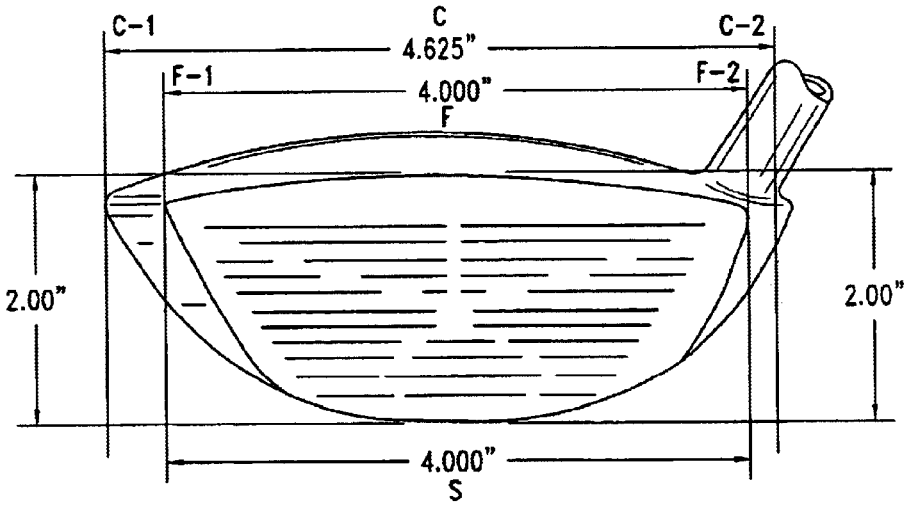
FIG. 23 (PRIOR ART)
FIG. 23 is a front elevation view of a prior art golf club.

FIG. 23 shows a typical prior art clubhead C having a ball-striking clubface F with an inverted trapezoidal shape whereby the hitting area on the clubface is reduced toward the bottom of the face F as the edges of the clubface F extend downwardly and inwardly from the bottom of the striking face F.

Figure 24:
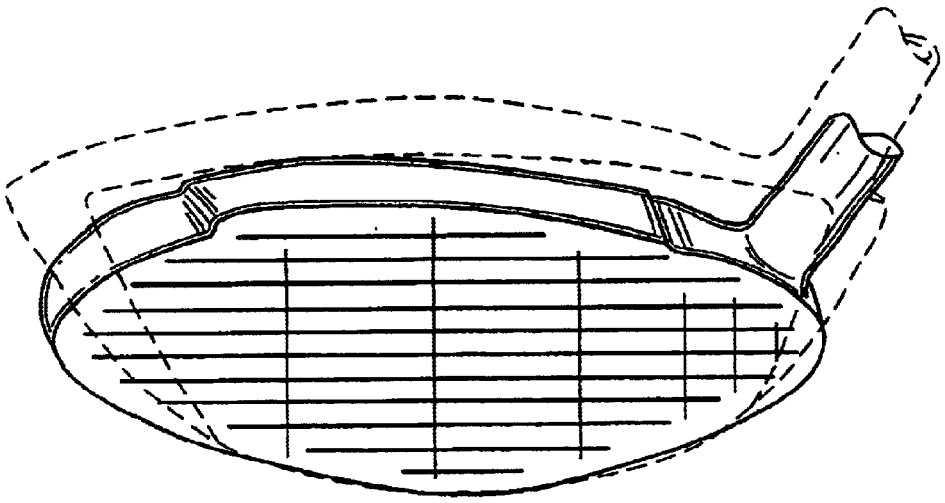
FIG. 24 is a phantom view of the FIG. 16 embodiment of the present invention superimposed on the prior art golf club of FIG. 23.

FIG. 24 shows a view of an embodiment of a golf clubhead in accordance with the present invention compared to a prior art clubhead, shown in phantom, of the type shown in FIG. 21. It can be seen the clubhead of the present invention provides considerable more hitting surface at the heel and toe portions parallel to and coincident with the clubface.

FIGS. 25 to 28 show a thirteenth embodiment of a metalwood type golf clubhead 1300. The clubhead 1300 is formed with a hosel 1302, ball-striking clubface 1320, upper crown surface 1306, heel 1308, toe 1310, upper side wall surface 1322, lower side wall surface 1324, rear wall surface 1314 and bottom sole surface 1316. The dotted lines 1311 in FIG. 25 outline the diminishing downward and inward direction of the ball-striking area of a traditional shaped clubface 1311 configuration on a traditional shaped clubhead. This graphically demonstrates the long existing difference between the ball-striking areas of traditional shaped club face and the additional expansion of the ball-striking surfaces 1321 and 1323 provided by the R/S member 1318 located parallel to and coincident with the toe and heel sections 1310 and 1308 of the present invention. An aerodynamically shaped reinforcing and stabilizing member 1318 is formed with a curved, generally parabolic outer, aerodynamic surface, which defines the outermost perimeter surfaces 1319 of the clubhead 1300. The reinforcing and stabilizing member 1318 locates a portion of its overall weight to the extreme outer edges 1319 of the golf clubhead 1300. The aerodynamically shaped reinforcing and stabilizing R/S member 1318 extends completely around and forms the outer perimeter of the clubhead 1300 and between the side wall surface 1322, and side wall surface 1324 from the toe 1310 to the heel 1308, terminating with front ball-striking surfaces 1321 and 1323 being coincident with and parallel to the ball-striking clubface 1320 at the heel 1308 and toe 1310, thereby expanding the ball-striking clubface 1320 outwardly in a lateral direction at the heel 1318 and toe 1310 of the clubhead 1300. In this embodiment the respective side walls 1322 and 1324 extend up to the upper crown surface 1306 and down to the bottom sole surface 1316. The aerodynamically shaped reinforcing and stabilizing member 1318 is located between the side wall surface 1322 and the lower wall surface 1324, approximately between the upper crown surface 1306 and the bottom surface 1316.

FIGS. 29 to 35 show a fourteenth embodiment of a golf clubhead 1400 in accordance with the present invention. The clubhead 1400 is formed with outer surfaces that are more aerodynamic than the previous embodiment shown in FIGS. 25 to 28. The golf clubhead 1400 includes a hosel 1402, ball-striking clubface 1404, top crown surface 1406, heel 1408, toe 1410, upper side wall 1422, lower side wall 1424, rear surface 1414 and bottom sole surface 1416. In accordance with the present invention, an aerodynamically shaped reinforcing and stabilizing member 1418 is formed on the side wails 1422 and 1424, and on rear surface 1414, to surround the clubhead and is located approximately midway between the upper crown surface 1406 and bottom sole surface 1416. The aerodynamically shaped reinforcing and stabilizing member 1418 includes two opposing ball-striking surfaces 1421, 1423, which are coincident with and parallel to clubface 1404 to increase the ball-striking surfaces on the ball-striking clubface 1404 located at the toe 1410 and the heel 1408 sections of clubface 1404.

Figure 33:
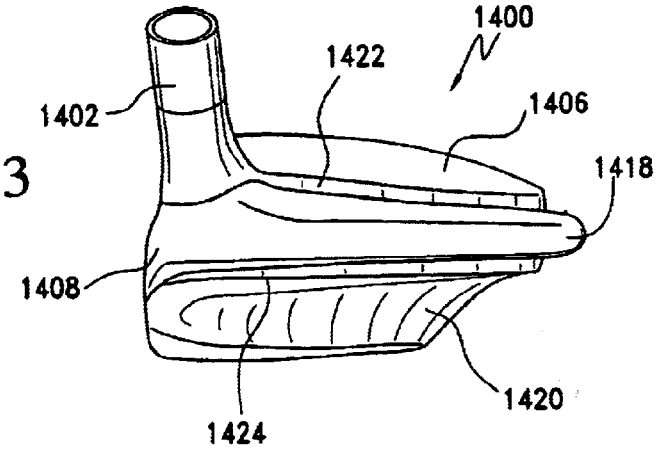
FIG. 33 is a heel end elevational view of the golf clubhead of FIG. 29.
Figure 34:
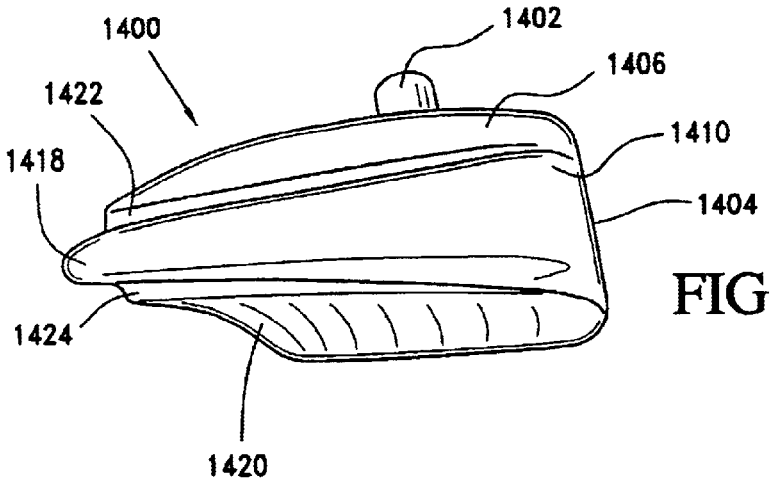
FIG. 34 is a toe end elevational view of the golf clubhead of FIG. 29.
Figure 35:
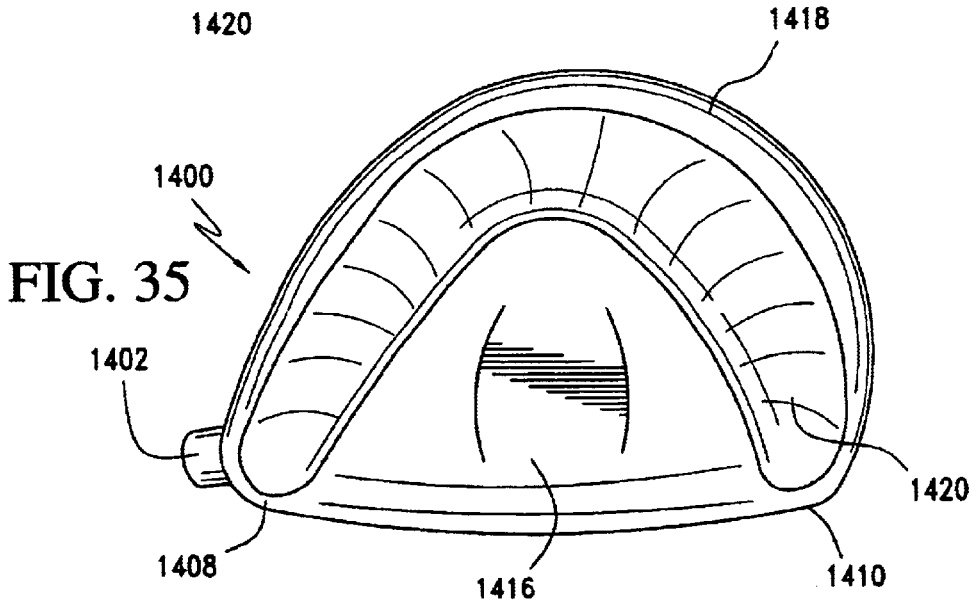
FIG. 35 is a bottom view of the golf clubhead of FIG. 29.

As can be seen in FIGS. 33 and 34, the side walls 1422 and 1424 and rear surface 1414 extend only partially in a downward direction from the upper crown surface 1406, the remaining structure forming a sloped aerodynamic, lower surface 1420 between lower side wall 1424 and the bottom sole surface 1416, as shown in FIG. 35. The aerodynamically shaped reinforcing and stabilizing member R/S 1418 extends outwardly from side walls 1422 and 1424, presenting generally parabolic shape at the extreme outer peripheral edge of the golf clubhead 1400. The aerodynamically shaped reinforcing and stabilizing member 1418 separates the upper side wall 1422 and the lower side wall surface 1424. In addition to creating a wider upper aerodynamic surface surrounding crown 1406, the aerodynamically shaped reinforcing and stabilizing member 1418 moves a portion of the overall weight to the extreme outer edge of the golf clubhead 1400.

FIGS. 36 and 37 show a fifteenth embodiment of a golf clubhead 1500, which is similar to the clubheads described hereinabove and includes a slightly smaller upper crown surface 1506 a wider reinforcing and stabilizing member 1518 including ball-striking surfaces 1510 and 1508 located parallel to and coincident with clubface 1520 and narrow side walls 1512 between the crown surface 1506 and reinforcing and stabilizing member 1518.

FIGS. 38 and 39 show a sixteenth embodiment of a golf clubhead 1600 formed with ball-striking clubface 1620, an upper crown surface 1606, side wall 1612 and an aerodynamically shaped reinforcing and stabilizing member 1618 including ball-striking surfaces 1610 and 1608 located parallel to and coincident with toe and heel sections of clubface 1620. In this embodiment, the clubhead 1600, is formed with a concave aerodynamic depression 1624 in the upper crown surface 1606 further adding to the aerodynamic characteristics of the clubhead 1600.

Figure 40:
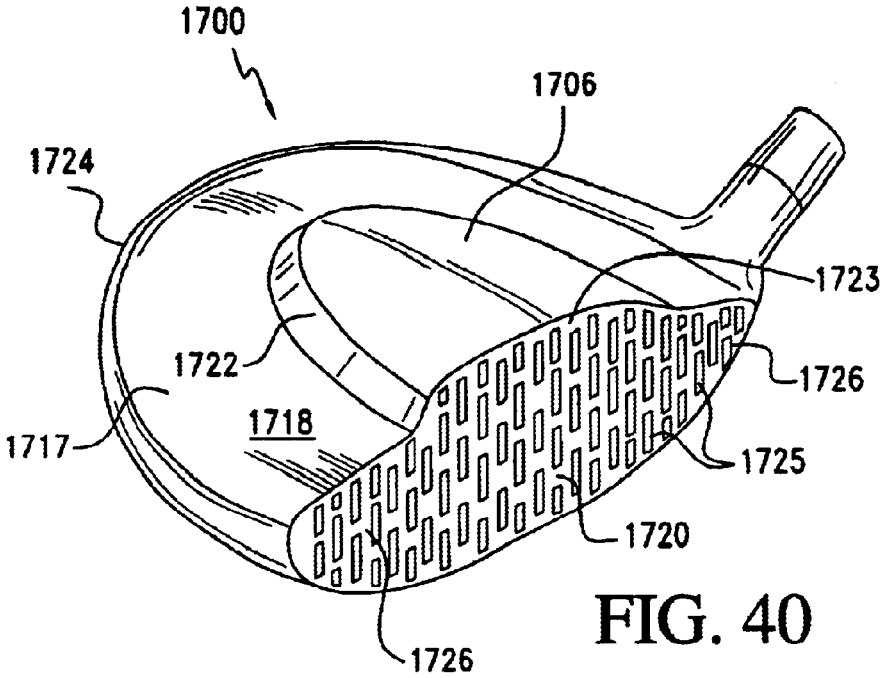
FIG. 40 is a front perspective view of a seventeenth embodiment of a golf clubhead in accordance with the present invention.
Figure 41:
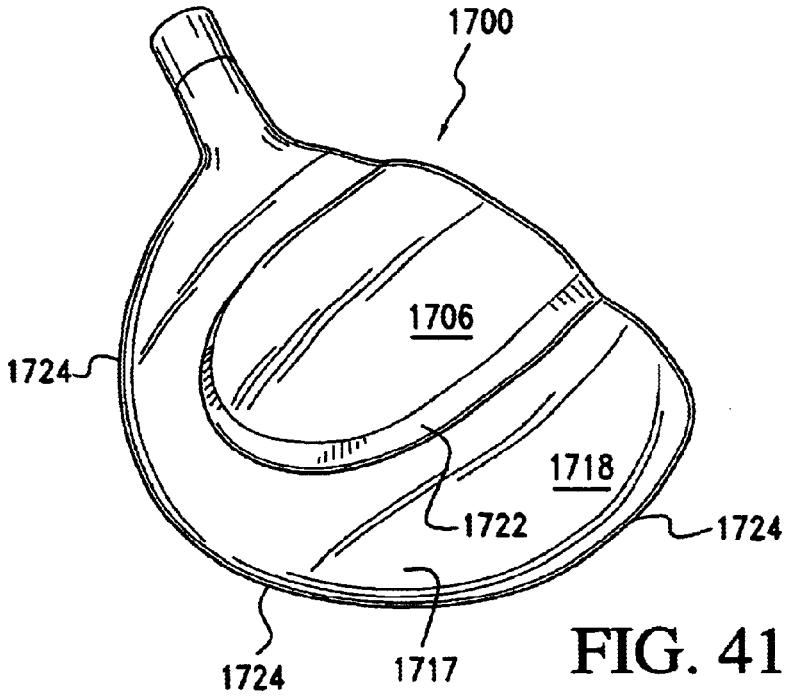
FIG. 41 is a top rear perspective view of the clubhead of FIG. 40.

FIGS. 40 and 41 show a seventeenth embodiment of a golf clubhead 1700 formed with ball-striking clubface 1720 having vertical grooves 1722, and a significantly smaller, raised, reinforcing and stabilizing upper crown member 1706 with an upper surface 1707. The upper crown member 1706 is formed with a single, upper ball-striking surface 1723, located above, perpendicular to and coincident with the upper portion of clubface 1720. The upper crown member 1706 is vertically disposed when the clubhead 1700 is in a normal address position with its bottom surface (not shown) flat on the grass or ground surface. A significantly larger aerodynamically shaped reinforcing and stabilizing R/S member 1718, including ball-striking surfaces 1726, has a wider, more aerodynamic upper surface of 1717 surrounding the smaller, raised, reinforcing and stabilizing upper crown member 1706. This structure moves a portion of the overall weight to the extreme outer edge 1724 of the golf clubhead 1700. The reinforcing and stabilizing member 1718 is disposed in a generally horizontal, heel to toe direction when the clubhead 1700 is soled in a normal address position on the ground surface. The upper side wall 1722 of the smaller, raised, reinforcing and stabilizing upper crown member 1706 is located further inward from the outer peripheral edge 1724 of the clubhead 1700. The forward ball-striking surfaces 1726 of the aerodynamically shaped reinforcing and stabilizing member 1718 are parallel to and coincident with the toe and heel sections of ball-striking clubface 1720, substantially increasing the overall ball-striking areas on clubface 1720, both horizontally and vertically.

Figure 42:
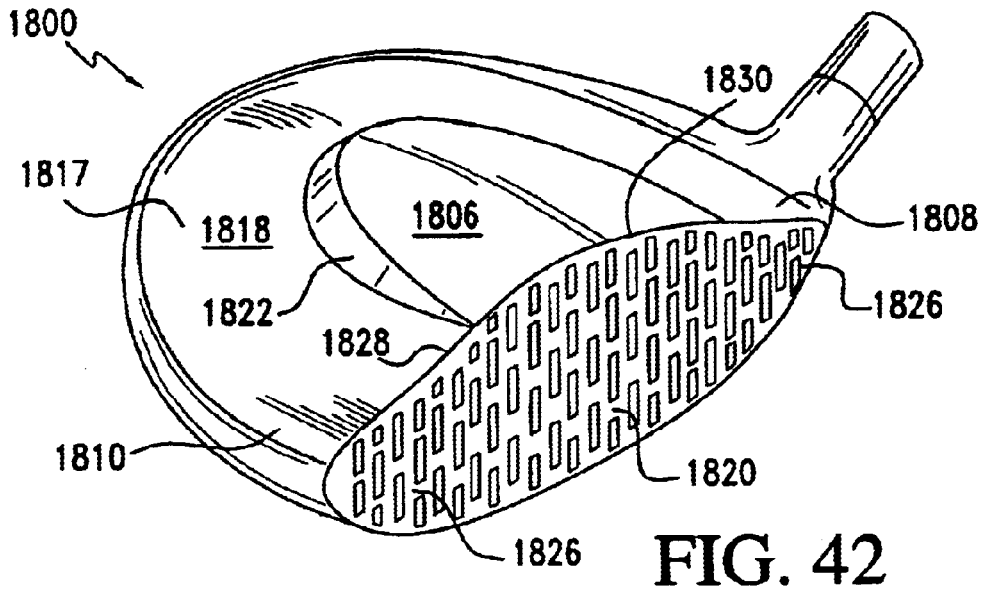
FIG. 42 is a front perspective view of an eighteenth embodiment of a golf clubhead in accordance with the present invention.
Figure 43:
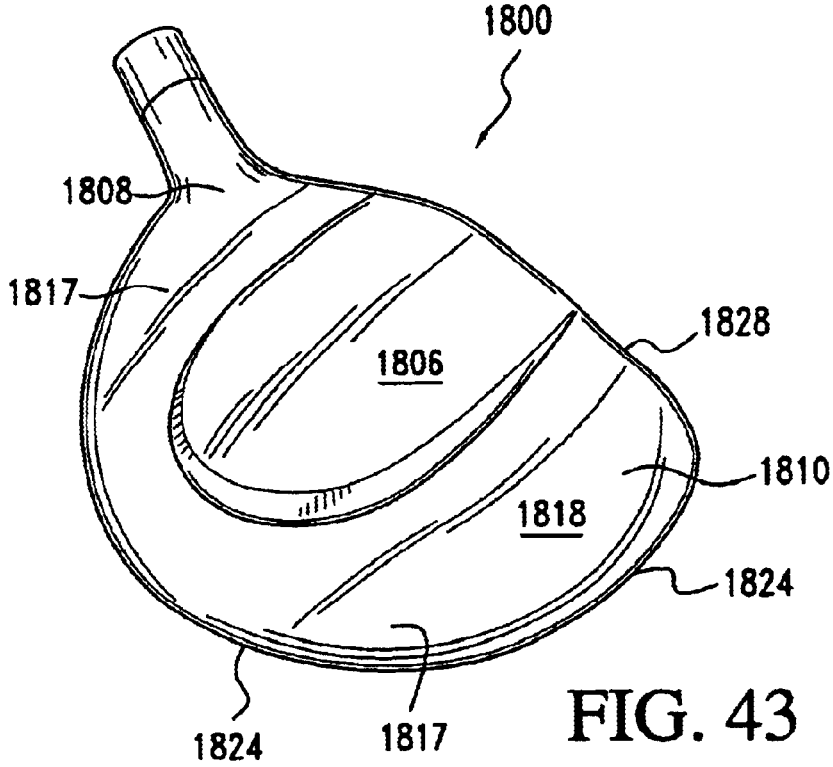
FIG. 43 is a top rear perspective view of the clubhead of FIG. 42.

FIGS. 42 and 43 show an eighteenth embodiment of a golf clubhead 1800, with a ball-striking clubface 1820, a downsized smaller, raised, reinforcing and stabilizing upper crown member 1806 having an upper surface 1807, and a significantly larger aerodynamically shaped reinforcing and stabilizing member 1818. Features of the aerodynamically shaped reinforcing and stabilizing member 1818 include wider ball-striking surfaces 1826, located parallel to toe 1810 and heel 1808 sections of clubface 1820, and a wider upper surface 1817. This structure locates a large portion of the overall weight to the extreme outer edge 1824 of the golf clubhead 1800. In this embodiment of clubhead 1800, the forward ball-striking faces 1826 of the aerodynamically shaped reinforcing and stabilizing member 1818 has an upper edge 1828 sloped to coincide with the upper edge 1830 of the ball-striking clubface 1820. Side wall 1822 also tapers toward the clubface 1820 coinciding with the upper edge 1828 of the aerodynamically shaped reinforcing and stabilizing R/S member 1818 and the upper edge 1830 of the clubface 1820, creating a smooth airfoil surface to accelerate the air flow across the upper surface of 1818 of the clubhead 1800.

Figure 44:
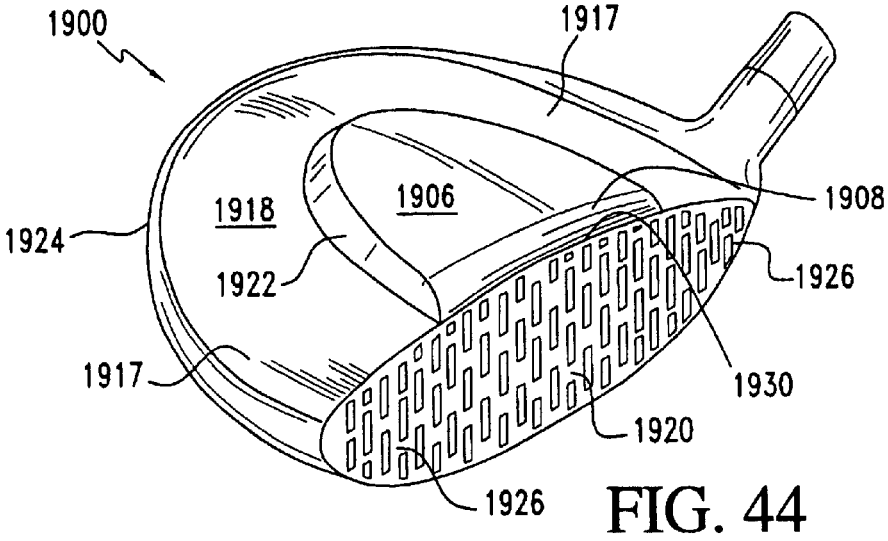
FIG. 44 is a front perspective view of an nineteenth embodiment of a golf clubhead in accordance with the present invention.
Figure 45:
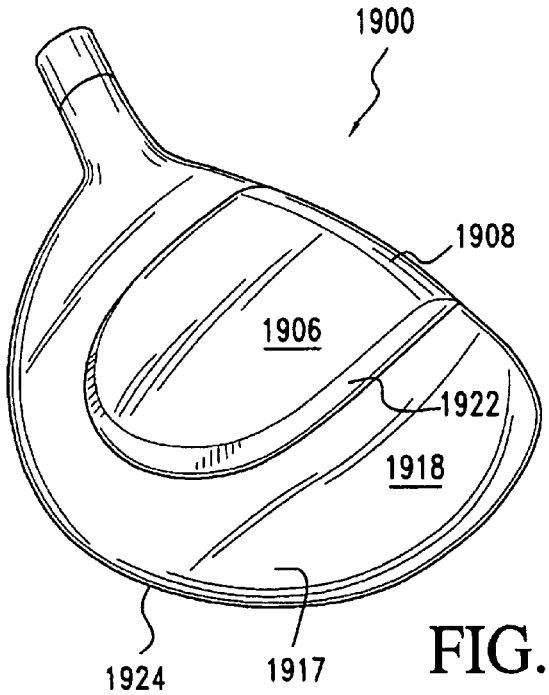
FIG. 45 is a top rear perspective view of the clubhead of FIG. 44.

FIGS. 44 and 45 show a nineteenth embodiment of a golf clubhead 1900, formed with ball-striking clubface 1920, a downsized smaller raised top crown surface 1906 having an upper surface 1907, sidewalls 1922 and a significantly larger aerodynamically shaped reinforcing and stabilizing member 1918. Features of the reinforcing and stabilizing member 1918 include a much wider upper aerodynamic surface 1917. This moves a significant portion of the overall weight to the extreme outer edge 1924 of the golf clubhead 1900, thus increasing the effective moment of inertia of the clubhead 1900. In this embodiment of the clubhead 1900, the forward edge 1908 of the raised top crown surface 1906 is sloped rearwardly and does not have a ball-striking surface to coincide with the upper edge 1930 of the ball-striking clubface 1920. The forward edge 1908 is curved to an airfoil shape and creates smooth airfoil surfaces to substantially minimize "drag" and increase the acceleration of air flow across the upper surfaces of the clubhead 1900.

FIGS. 46 and 47 show a twentieth embodiment of clubhead 2000, having an upper crown surface 2010 and a ball striking clubface 2020. The clubhead 2000 includes two aerodynamically shaped, reinforcing and stabilizing members 2006 and 2018, both of which having forward ball striking surfaces which are coincident with the ball-striking face 2020. The clubhead 2000 includes an upper shelf surface 2010 located between the reinforcing and stabilizing members 2006 and 2018. The first aerodynamically shaped, reinforcing and stabilizing member 2006 includes a raised top surface 2007, and sidewalls 2024 and an upper ball-striking face 2012, centrally located above and coincident with the upper portion of the main ball striking clubface 2020, in a perpendicular, top to bottom direction relative to the clubface 2020. The second aerodynamically shaped, reinforcing and stabilizing member 2018 is separated from the upper shelf surface 2010 by sidewalls 2022, and includes two ball-striking faces 2023 located parallel to and coincident with the toe 2009 and heel 2008 sections of the clubface 2020. Combining two aerodynamically shaped reinforcing and stabilizing members on the same clubhead, substantially increases the ball-contact area of the clubface 2020, specifically at the toe and heel sections and above the central upper portion of the clubface 2020. The structure of the clubhead 2000 provides improved aerodynamics and substantially expands the ball-contact areas located parallel to and perpendicular to the clubface 2020. This results in faster acceleration, and, at the same time, produces the most solid-ball contacts made on the greatly enlarged hitting areas for straighter and longer ball flights.

FIG. 48 shows a twenty-first embodiment of a golf clubhead 2100 similar to the embodiment shown in FIGS. 46 and 47, and includes an upper shelf surface 2110 and aerodynamically shaped reinforcing and stabilizing members 2108 and 2118 on the top and sides respectively of the clubhead 2100. This embodiment differs in the shape of the raised, upper aerodynamically shaped reinforcing and stabilizing member 2108, which extends to the rear 2126 of the clubhead 2100 and forms an arcuate shape at the interface of member 2108 and the rear 2126 of the clubhead 2100.

While various preferred embodiments have been shown and described, it will be understood that there is no intent to limit the invention by such disclosure, but rather, is intended to cover all modifications and alternate constructions falling within the spirit and scope of the invention as defined in the following claims.

What is claimed is:

1. A metalwood type golf club head including a club head body with a toe, heel, upper crown surface, bottom sole surface, side wall surfaces, rear wall surface and ball striking club face, wherein the improvement comprises:

means on said side wall surfaces expanding outer perimeter weighting and providing improved low profile aerodynamics to said club head;

said means including a raised, elongated, aerodynamically shaped reinforcing and stabilizing member extending outwardly from said side wall surfaces, said member having at least one frontal ball striking surface being coincident with said ball striking club face; and, further including an expanded section extending outwardly beyond said club head body in a direction between said upper crown surface and said bottom sole surface;

said expanded section having a frontal surface coincident with said ball striking club face.

2. The golf club head of claim 1 being further defined by said reinforcing and stabilizing member extending outwardly around the entire side wall surfaces and said rear surface of said club head;

said reinforcing and stabilizing member being located between said heel and said toe;

said reinforcing and stabilizing member having a first frontal ball striking surface located at said toe and being coincident with said ball striking club face and a second frontal ball striking surface located at said heel and being coincident with said bail striking club face.

3. The golf club head of claim 1 wherein said expanded section is located below said ball striking club face extending outwardly from said bottom sole surface, said frontal surface of said frontal surface coincident with said ball striking club face of said expanded section further expanding the ball striking club face in a direction toward said bottom sole surface.

4. The golf club head of claim 1 wherein said aerodynamically shaped reinforcing and stabilizing member and said expanded section have parabolic shaped outer surfaces.

5. The golf club head of claim 1 wherein said aerodynamically shaped reinforcing and stabilizing member and said expanded section are formed with a variable thickness.

6. The golf club head of claim 5 wherein said aerodynamically shaped reinforcing and stabilizing member and said expanded section are formed with a thickness greater than the thickness of said club head body.

7. The golf club head of claim 6 wherein said thickness of said aerodynamically shaped reinforcing and stabilizing member is within the range of 0.055 to 0.100-inch.

8. A metalwood type golf club head including a club head body with a toe, heel, upper crown surface, bottom sole surface, side wall surfaces, rear wall surface and ball striking club face, wherein the improvement comprises:

means on said side wall surfaces expanding outer perimeter weighting and providing improved low profile aerodynamics to said club head, said means including a raised, elongated, aerodynamically shaped reinforcing and striking member extending outwardly around the entire side wall surfaces and said rear surface of said club head;

said reinforcing and stabilizing member being located between said heel and said toe;

said reinforcing and stabilizing member having a first frontal ball striking surface at said toe being coincident with said ball striking club face and a second frontal ball striking surface at said heel being coincident with said ball striking club face; and, including an expanded section extending outwardly from said club head body in a direction between said upper crown surface and said bottom sole surface;

said expanded section having a further frontal surface coincident with said ball striking club face.

9. The golf club head of claim 8 wherein said expanded section is located below said ball striking club face extending outwardly from said bottom sole surface, said frontal surface being coincident with said ball striking club face of said expanded section further expanding the ball striking club face in a direction beyond said bottom sole surface.

* * * * *